US009840391B2

(12) United States Patent
Taki

(10) Patent No.: US 9,840,391 B2
(45) Date of Patent: Dec. 12, 2017

(54) SHEET PROCESSING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Hiroyuki Taki, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/218,684

(22) Filed: Jul. 25, 2016

(65) Prior Publication Data

US 2017/0183188 A1 Jun. 29, 2017

(30) Foreign Application Priority Data

Dec. 24, 2015 (JP) ..... 2015-251097

(51) Int. Cl.

| | |
|---|---|
| ***B65H 31/30*** | (2006.01) |
| ***B65H 31/34*** | (2006.01) |
| ***B65H 29/14*** | (2006.01) |
| ***B65H 7/20*** | (2006.01) |
| ***B65H 31/38*** | (2006.01) |

(52) U.S. Cl.

CPC ..... *B65H 31/3081* (2013.01); *B65H 7/20* (2013.01); *B65H 29/14* (2013.01); *B65H 29/145* (2013.01); *B65H 31/34* (2013.01); *B65H 31/38* (2013.01); *B65H 2301/3621* (2013.01); *B65H 2408/1222* (2013.01); *B65H 2513/51* (2013.01)

(58) Field of Classification Search

CPC .... B65H 31/3081; B65H 31/34; B65H 31/36; B65H 29/145; B65H 2301/3621

USPC ..... 271/221

See application file for complete search history.

(56) References Cited

U.S. PATENT DOCUMENTS

| | | | | |
|---|---|---|---|---|
| 6,220,592 | B1 | 4/2001 | Watanabe et al. | |
| 6,905,118 | B2 * | 6/2005 | Yamada | B65H 45/18 270/20.1 |
| 7,043,192 | B2 | 5/2006 | Terao et al. | |
| 7,215,922 | B2 | 5/2007 | Terao et al. | |
| 7,286,792 | B2 | 10/2007 | Terao et al. | |
| 7,448,615 | B2 * | 11/2008 | Takamura | B42C 1/12 270/58.11 |
| 7,669,847 | B2 * | 3/2010 | Yamaguchi | B65H 31/38 270/58.17 |

(Continued)

*Primary Examiner* — Patrick Cicchino

(74) *Attorney, Agent, or Firm* — Amin, Turocy & Watson LLP; Gregory Turocy

(57) ABSTRACT

In accordance with an embodiment, a sheet processing apparatus comprises a processing tray configured to load sheets to which a post processing is executed; a pair of alignment plates arranged on the processing tray at a predetermined interval and configured to move in a direction orthogonal to a sheet conveyance direction and align the sheets on the processing tray in the sheet width direction; and a controller configured to control the pair of the alignment plates to move towards each other to first alignment positions at which the sheets are aligned in the direction and stop, and control the pair of the alignment plates to move towards each other to second alignment positions without moving the pair of the alignment plates in a reverse direction to align the sheets.

8 Claims, 19 Drawing Sheets

(56) References Cited

U.S. PATENT DOCUMENTS

| | | | | |
|---|---|---|---|---|
| 7,922,163 | B2 * | 4/2011 | Ichihashi | B42B 4/00 270/58.07 |
| 7,934,714 | B2 * | 5/2011 | Ichihashi | B65H 9/101 270/58.07 |
| 7,997,577 | B2 | 8/2011 | Oshiro et al. | |
| 8,246,034 | B2 * | 8/2012 | Tsuchiya | B42B 4/00 270/58.07 |
| 9,415,966 | B2 * | 8/2016 | Nishi | B65H 31/02 |
| 2007/0035080 | A1 * | 2/2007 | Yamada | B26D 1/205 270/58.07 |
| 2009/0014939 | A1 * | 1/2009 | Ichihashi | B65H 31/3027 271/3.02 |
| 2011/0057378 | A1 * | 3/2011 | Iguchi | B42C 1/12 270/58.11 |
| 2011/0115152 | A1 | 5/2011 | Sugizaki | |
| 2013/0341854 | A1 * | 12/2013 | Miyakawa | B65H 1/04 271/145 |
| 2015/0014913 | A1 * | 1/2015 | Obuchi | B65H 31/36 270/58.12 |

* cited by examiner

SHEET PROCESSING APPARATUS

CROSS-REFERENCE TO RELATED APPLICATION

This application is based upon and claims the benefit of priority from Japanese Patent Application No. 2015-251097, filed Dec. 24, 2015, the entire contents of which are incorporated herein by reference.

FIELD

Embodiments described herein relate generally to a sheet processing apparatus for carrying out a post processing on a sheet on which an image is formed.

BACKGROUND

Conventionally, a sheet processing apparatus is known which executes post processing such as a stapling processing on sheets loaded on a processing tray. In order to adjust deviation between the sheets loaded on the processing tray which are subjected to the post processing, the sheet processing apparatus includes a member for adjusting (horizontally aligning) the deviation of the sheet in a width direction and a member for adjusting (vertically aligning) the deviation in a direction orthogonal to the width direction of the sheet.

DETAILED DESCRIPTION

In accordance with an embodiment, a sheet processing apparatus comprises a processing tray configured to load sheets to which a post processing is executed; a pair of alignment plates arranged on the processing tray at a predetermined interval and configured to move in a direction orthogonal to a sheet conveyance direction and align the sheets on the processing tray in the sheet width direction; and a controller configured to control the pair of the alignment plates to move towards each other to first alignment positions at which the sheets are aligned in the direction and stop, and control the pair of the alignment plates to move towards each other to second alignment positions without moving the pair of the alignment plates in a reverse direction to align the sheets. In accordance with another embodiment, sheet processing method involves loading sheets on a processing tray; aligning the sheets in a sheet width direction orthogonal to a sheet conveyance direction using a pair of alignment plates arranged on the processing tray at a predetermined interval; moving the pair of the alignment plates towards each other; positioning the pair of the alignment plates at first alignment positions at which the sheets are aligned in the sheet width direction; moving the pair of the alignment plates towards each other from the first positions; positioning the pair of the alignment plates at second alignment positions to align the sheets, an interval between the pair of the alignment plates at the second alignment positions being narrower than that at the first alignment positions. Hereinafter, the sheet processing apparatus of the embodiment is described with reference to the accompanying drawings. Furthermore, in the following description, the same numerals are applied to configurations having identical or similar functions. Further, there is a case in which the repeated descriptions of these configurations are omitted.

Figure 1:
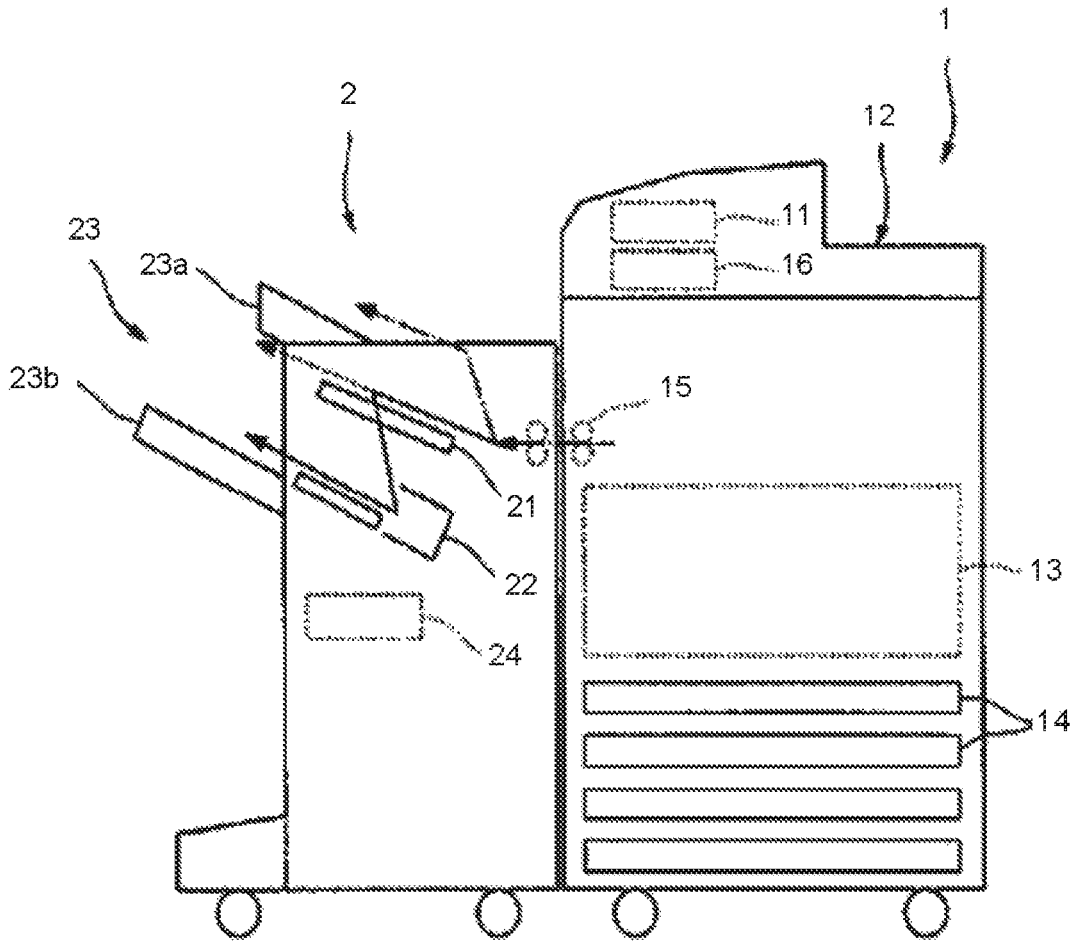
FIG. 1 is a diagram illustrating an image forming system according to an embodiment.
Figure 2:
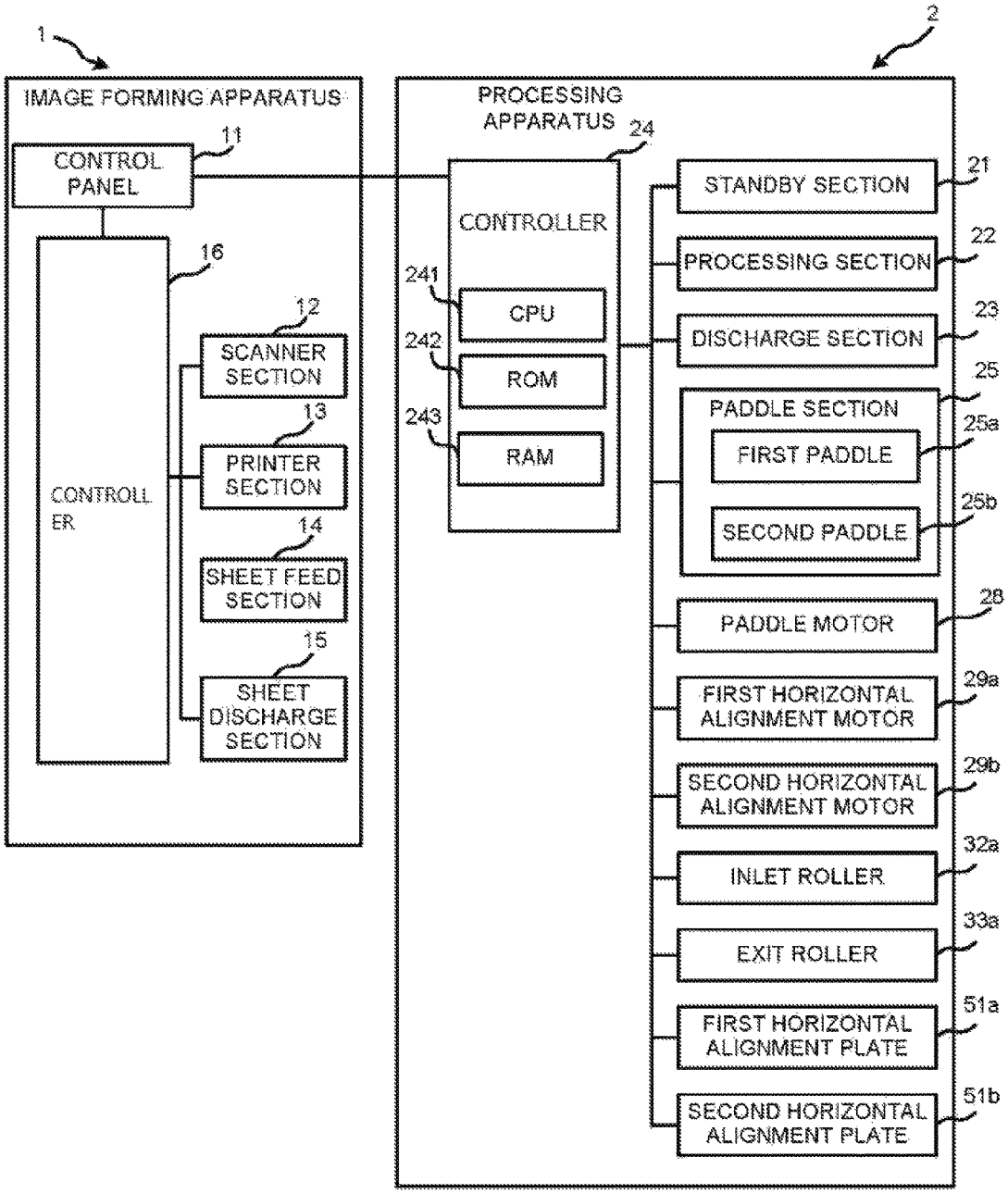
FIG. 2 is an electrical block diagram illustrating an image forming apparatus and a sheet processing apparatus according to the present embodiment.

FIG. 1 is a diagram illustrating the entire configuration of an image forming system. FIG. 2 is an electrical block diagram illustrating an image forming apparatus and the sheet processing apparatus. The image forming system contains an image forming apparatus 1 and a sheet processing apparatus 2. The image forming apparatus 1 forms an image on a sheet-like medium (hereinafter, referred to as a "sheet") such as a paper. The sheet processing apparatus 2 carries out a post processing on a sheet conveyed from the image forming apparatus 1.

The image forming apparatus 1 shown in FIG. 1 includes a control panel 11, a scanner section 12, a printer section 13, a sheet feed section 14, a sheet discharge section 15 and a controller 16.

The control panel 11 has interface including various keys for receiving operations of a user. For example, the control panel 11 receives an input relating to a type of the post processing of the sheet. The control panel 11 sends information relating to the input type of the post processing to the sheet processing apparatus 2.

The scanner section 12 includes a reading section for reading image information of a copy object. The scanner section 12 sends the read image information to the printer section 13.

The printer section 13 forms an image (hereinafter, referred to as a "toner image") with a developing agent such as toner on the basis of the image information sent from the scanner section 12 or an external device. The printer section 13 transfers the toner image onto a surface of the sheet. The printer section 13 fixes the toner image by applying heat and pressure to the toner image transferred onto the sheet.

The sheet feed section 14 supplies the sheets one by one to the printer section 13. The sheet discharge section 15 conveys the sheet from the printer section 13 to the sheet processing apparatus 2.

As shown in FIG. 2, the controller 16 controls all operations of the image forming apparatus 1. In other words, the controller 16 controls the control panel 11, the scanner section 12, the printer section 13, the sheet feed section 14 and the sheet discharge section 15. The controller 16 is formed by a control circuit containing a CPU, a ROM and a RAM that are not shown.

Next, the configuration of the sheet processing apparatus 2 is described with reference to FIG. 1 and FIG. 2. As shown in FIG. 1, the sheet processing apparatus 2 is arranged adjacent to the image forming apparatus 1. The sheet processing apparatus 2 executes a post processing designated through the control panel 11 or the external device such as a client PC on the sheet conveyed from the image forming apparatus 1. For example, the post processing includes a stapling processing or a sorting processing.

The sheet processing apparatus 2 includes a standby section 21, a processing section 22, a discharge section 23 and a controller 24. The standby section 21 temporarily buffers a sheet S (refer to FIG. 3) conveyed from the image forming apparatus 1. For example, the standby section 21 enables a plurality of succeeding sheets S to stand by while the post processing on the preceding sheets S is carried out by the processing section 22. The standby section 21 is arranged above the processing section 22. The standby section 21 enables the buffered sheet S to drop towards the processing section 22 if the sheet in the processing section 22 is discharged to the discharge section 23.

The processing section 22 carries out the post processing on the sheets S. For example, the processing section 22 carries out the stapling processing on a plurality of the aligned sheets S. In this way, a plurality of the sheets S is bound together by staples. The processing section 22 discharges the sheets S to which the post processing is carried out to the discharge section 23.

The discharge section 23 includes a fixed tray 23*a* and a movable tray 23*b*. The fixed tray 23*a* is arranged on the upper part of the sheet processing apparatus 2. The movable tray 23*b* is arranged on the side of the sheet processing apparatus 2. The sheet S to which the stapling processing or the sorting processing is carried out is discharged to the movable tray 23*b*.

As shown in FIG. 2, the controller 24 controls all operations of the sheet processing apparatus 2. In other words, the controller 24 controls the standby section 21, the processing section 22 and the discharge section 23. Further, as shown in FIG. 2, the controller 24 controls an inlet roller 32*a*, an exit roller 33*a*, a paddle section 25, a paddle motor 28, a first horizontal alignment motor 29*a*, a second horizontal alignment motor 29*b*, a first horizontal alignment plate 51*a* and a second horizontal alignment plate 51*b*. The controller 24 includes a control circuit containing a CPU 241, a ROM 242 and a RAM 243. In the present embodiment, two motors including the first horizontal alignment motor 29*a* and the second horizontal alignment motor 29*b* are used; however, one motor may be used to move each of the first horizontal alignment plate 51*a* and the second horizontal alignment plate 51*b*.

Figure 3:
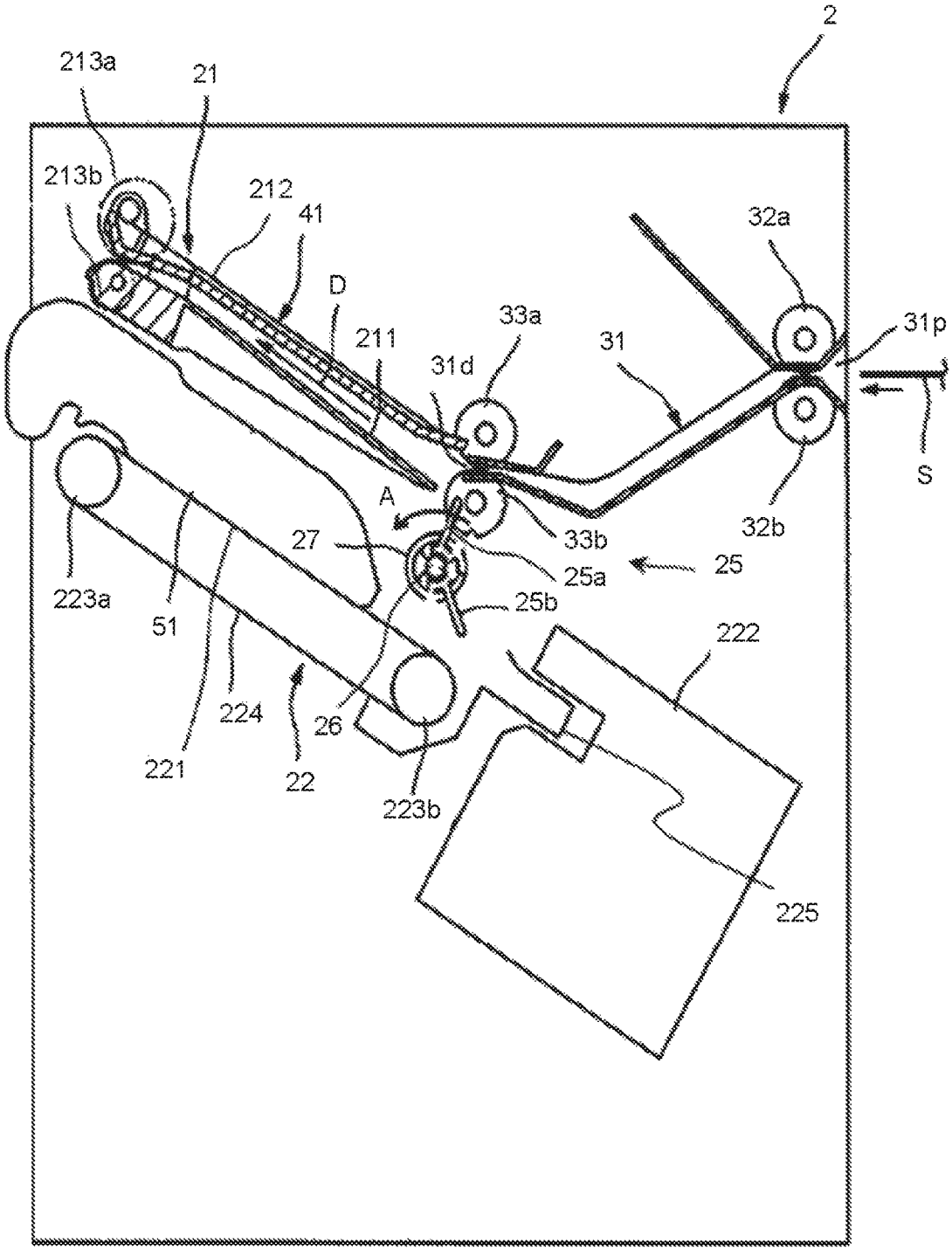
FIG. 3 is a diagram schematically illustrating details of the configuration of each section of the sheet processing apparatus according to the present embodiment.

FIG. 3 illustrates a configuration of the sheet processing apparatus 2. Furthermore, a "sheet conveyance direction" described in the present embodiment refers to a conveyance direction D of the sheet S to a standby tray 211 of the standby section 21 (an approach direction of the sheet S to a standby tray 211) or a direction in which the sheet S is conveyed from a processing tray 221 to the movable tray 23*b*.

Further, an "upstream side" and a "downstream side" described in the present embodiment respectively refer to the upstream side and the downstream side in the sheet conveyance direction D. Further, a "front end part" and a "back end part" described in the present embodiment respectively refer to "the end part of the downstream side" and "the end part of the upstream side" in the sheet conveyance direction D. In the present embodiment, a direction orthogonal to the sheet conveyance direction D is referred to as a sheet width direction W.

Hereinafter, the details of the configuration of each section of the sheet processing apparatus 2 are based on FIG. 3. A conveyance path 31 is a conveyance path from a sheet supply port 31*p* to a sheet discharge port 31*d*. The sheet supply port 31*p* is arranged at a position facing the image forming apparatus 1. The sheet S is supplied from the image forming apparatus 1 to the sheet supply port 31*p*. On the other hand, the sheet discharge port 31*d* is located in the vicinity of the standby section 21. The sheet S discharged from the image forming apparatus 1 is discharged to the standby section 21 via the conveyance path 31.

The inlet rollers 32*a* and 32*b* are arranged in the vicinity of the sheet supply port 31*p*. The inlet rollers 32*a* and 32*b* convey the sheet S supplied to the sheet supply port 31*p* towards the downstream side of the conveyance path 31. For example, the inlet rollers 32*a* and 32*b* convey the sheet S supplied to the sheet supply port 31*p* to the exit rollers 33*a* and 33*b*.

The exit rollers 33*a* and 33*b* are arranged in the vicinity of the sheet discharge port 31*d*. The exit rollers 33*a* and 33*b* receive the sheet S conveyed by the inlet rollers 32*a* and 32*b*. The exit rollers 33*a* and 33*b* convey the sheet S from the sheet discharge port 31*d* to the standby section 21.

The standby section 21 includes the standby tray (buffer tray) 211, a conveyance guide 212, discharge rollers 213*a* and 213*b* and an opening and closing driving section (not shown).

The back end part of the standby tray 211 is located in the vicinity of the exit rollers 33*a* and 33*b*. The back end part of the standby tray 211 is located slightly below the sheet discharge port 31*d* of the conveyance path 31. The standby tray 211 is inclined with respect to the horizontal direction in such a way as to gradually rise towards the downstream side of the sheet conveyance direction D. The standby tray 211 stacks a plurality of the sheets S to enable them to stand by while the post processing is carried out by the processing section 22.

Figure 4:
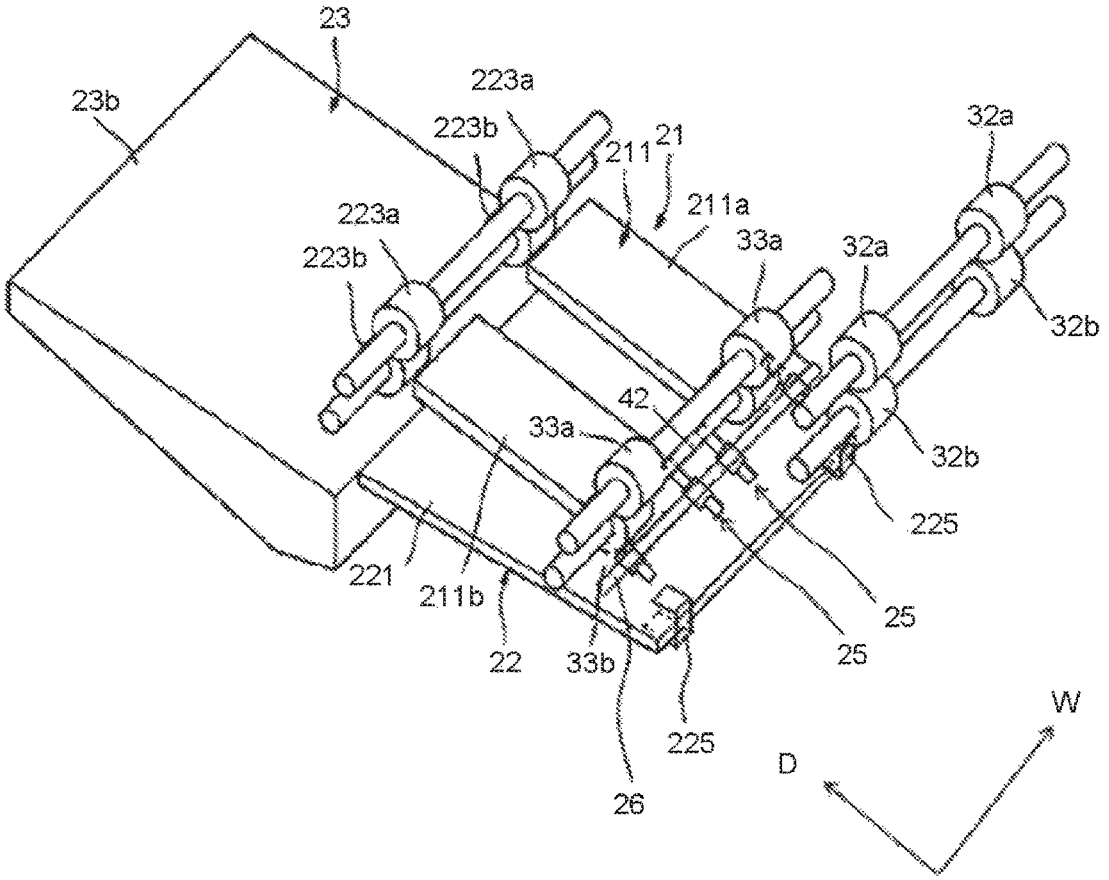
FIG. 4 is a diagram schematically illustrating a relation between a standby tray and a paddle section according to the present embodiment.

FIG. 4 illustrates a relation between the standby tray 211 and the paddle section 25 described later. As shown in FIG. 4, the standby tray 211 includes a first tray member 211*a* and a second tray member 211*b*. The first tray member 211*a* and the second tray member 211*b* are separated from each other in a sheet width direction W. The first tray member 211*a* and the second tray member 211*b* is driven by the opening and closing driving section and move in a mutually approaching direction and in a mutually separating direction.

The first tray member 211*a* and the second tray member 211*b* support the sheet S conveyed from the exit rollers 33*a* and 33*b* in a state in which the first tray member 211*a* and the second tray member 211*b* approach each other. On the other hand, the first tray member 211*a* and the second tray member 211*b* are separated in the mutually separating direction in the sheet width direction W to enable the sheet S to move from the standby tray 211 towards the processing tray 221. In this way, the sheet S supported by the standby tray 211 drops from a space between the first tray member 211*a* and the second tray member 211*b* towards the processing tray 221. In other words, the sheet S moves from the standby tray 211 to the processing tray 221.

An assist arm 41 shown in FIG. 3 is arranged above the standby tray 211. For example, the length of the assist arm 41 is approximately half or more of that of the standby tray 211 in the sheet conveyance direction D. In the present embodiment, the assist arm 41 has the approximately same length as the standby tray 211 in the sheet conveyance direction D. The assist arm 41 is a plate-like member extending upwards the standby tray 211. The sheet S discharged from the exit rollers 33*a* and 33*b* enters into the space between the assist arm 41 and the standby tray 211.

The processing section 22 shown in FIG. 3 includes the processing tray 221, a stapler 222, conveyance rollers 223*a* and 223*b*, and a conveyance belt 224, a stopper 225 and a horizontal alignment section 51 (the first horizontal alignment plate 51*a* and the second horizontal alignment plate 51*b*).

The processing tray 221 is arranged below the standby tray 211. The processing tray 221 is inclined with respect to the horizontal direction in such a way as to gradually rise towards the downstream side of the sheet conveyance direction D. The processing tray 221 is inclined approximately parallel to the standby tray 211. As for a plurality of sheets S moved to the processing tray 221, deviation between the sheets S in the sheet width direction W is aligned by the first horizontal alignment plate 51*a* and the second horizontal alignment plate 51*b*.

The stapler 222 is arranged at an end part of the processing tray 221. The stapler 222 carries out a stapling (binding) processing on a bundle of the predetermined number of sheets S located on the processing tray 221.

The conveyance rollers 223*a* and 223*b* are arranged at a predetermined interval in the sheet conveyance direction D. The conveyance belt 224 is stretched over the conveyance rollers 223*a* and 223*b*. The conveyance belt 224 is rotated in synchronization with the conveyance rollers 223*a* and 223*b*. The conveyance belt 224 conveys the sheet S between the stapler 222 and the discharge section 23.

The stopper 225 is arranged at the upstream side of the sheet conveyance direction when viewed from the conveyance roller 223*b*. The stopper 225 is a member for receiving an end of the sheets S moved from the standby tray 211 to the processing tray 221 to align the sheets in the sheet conveyance direction. In other words, the stopper 225 is a member serving as a sheet reference position when an alignment processing in the sheet conveyance direction is executed. In other words, the sheets S moved towards the upstream side of the sheet conveyance direction through a first paddle 25*a* and a second paddle 25*b* described later are struck against the stopper 225 to be aligned in the sheet conveyance direction. Hereinafter, aligning the sheets in the sheet conveyance direction is referred to as a vertical alignment processing.

The paddle section 25 shown in FIG. 3 includes the first paddle 25*a*, the second paddle 25*b*, a rotational axis 26 and a rotating body 27.

The rotational axis 26 is a rotation center of the first paddle 25*a* and the second paddle 25*b* described later. The rotational axis 26 is located below the standby tray 211. The rotational axis 26 extends in the sheet width direction W. The rotational axis 26 receives driving force from the paddle motor 28 to rotate in an arrow A direction (in a counter-clockwise direction) in FIG. 3.

The first paddle 25*a* and the second paddle 25*b* are formed with an elastic material such as rubber or resin. The first paddle 25*a* protrudes to the diameter direction of the rotating body 27 to be mounted in the rotating body 27.

As shown in FIG. 3, the second paddle 25*b* is arranged to have a predetermined angle with respect to the first paddle 25*a*. In other words, the second paddle 25*b* is arranged to have a predetermined distance away from the rear of the first paddle 25*a* in a rotation direction A.

The second paddle 25*b* protrudes to the diameter direction of the rotating body 27 to be mounted in the rotating body 27. The second paddle 25*b* has a length shorter than a length of the first paddle 25*a* in the diameter direction of the rotating body 27.

It is preferred that the first paddle 25*a* and the second paddle 25*b* have the following relations in order that the drawing-in quantity of the sheets S by the first paddle 25*a* is greater than that by the second paddle 25*b*. For example, as for the materials of the first paddle 25*a* and the second paddle 25*b*, it is preferred that Young's modulus of the first paddle 25*a* is greater than that of the second paddle 25*b* in order that the stress generated due to the bend of the first paddle 25*a* is greater than that generated due to the bend of the second paddle 25*b*. As for the hardness of the first paddle 25*a* and the second paddle 25*b*, it is preferred that the hardness of the first paddle 25*a* is higher than that of the second paddle 25*b*. Further, as for the relation between the thicknesses of the first paddle 25*a* and the second paddle 25*b*, it is preferred that the thickness of the first paddle 25*a* is thicker than that of the second paddle 25*b*. Particularly, it is preferred that the thickness of the first paddle 25*a* at a location where it contacts with the sheet S is thicker than that of the second paddle 25*b* at a location where it contacts with the sheet S. Furthermore, it is unnecessary to meet all the relations described above, and it is applicable to meet at least one relation.

Figure 5:
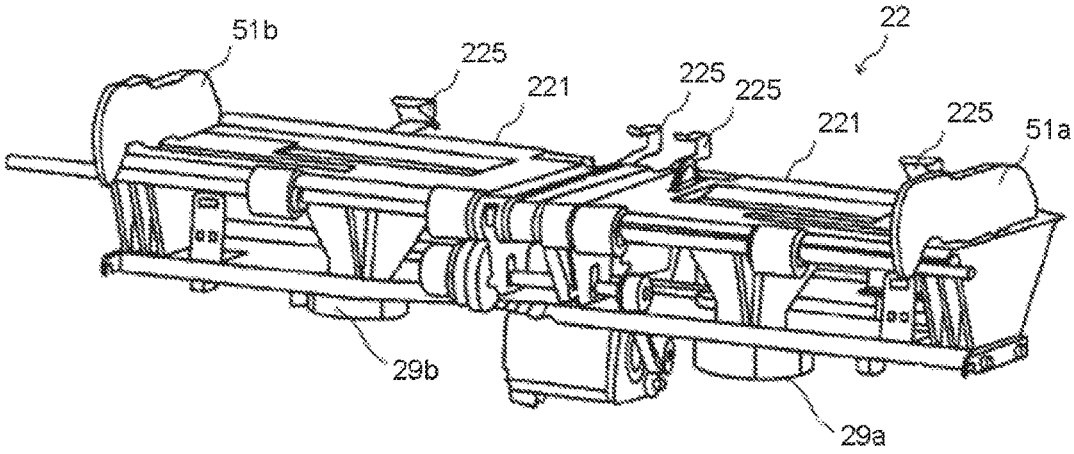
FIG. 5 is a perspective view illustrating the detailed configuration of a processing section according to the present embodiment.

FIG. 5 is a perspective view illustrating the detailed configuration of the processing section 22. The horizontal alignment section 51 includes a pair of horizontal alignment plates 51*a* and 51*b*. The first horizontal alignment plate 51*a* is a horizontal alignment plate located at the front side of the sheet processing apparatus, and the second horizontal alignment plate 51*b* is a horizontal alignment plate located at the rear side of the sheet processing apparatus in FIG. 3. The first horizontal alignment plate 51*a* and the second horizontal alignment plate 51*b* is possible to slide in a W direction serving as a sheet width direction orthogonal to a sheet conveyance direction through the first horizontal alignment motor 29*a* and the second horizontal alignment motor 29*b* to match with the width of the sheet S. The horizontal alignment section 51 can change the position of the sheet S by sliding the first horizontal alignment plate 51*a* and the second horizontal alignment plate 51*b* in the width direction (W direction) of the sheet S. Further, the first horizontal alignment plate 51*a* and the second horizontal alignment plate 51*b* are also used at the time of sorting the sheet S to discharge it.

The first horizontal alignment plate 51*a* and the second horizontal alignment plate 51*b* are arranged to have a predetermined space (interval) therebetween at home positions. The sheet S moved from the standby tray 211 is loaded in the space between the first horizontal alignment plate 51*a* and the second horizontal alignment plate 51*b*. The sheets S are sandwiched by the first horizontal alignment plate 51*a* and the second horizontal alignment plate 51*b* to be aligned in the sheet width direction orthogonal to the conveyance direction of the sheet. A damper is arranged in the first horizontal alignment plate 51*a*. The damper may be a spring type or may be formed with a member molded by a flexible material such as resin.

Further, in FIG. 5, the first horizontal alignment motor 29*a* and the second horizontal alignment motor 29*b* for driving the first horizontal alignment plate 51*a* and the second horizontal alignment plate 51*b* are mounted below the processing tray 221.

A series of horizontal alignment processing executed by the first horizontal alignment plate 51*a* and the second horizontal alignment plate 51*b* is described with reference to FIG. 6 and FIG. 10.

Figure 6:
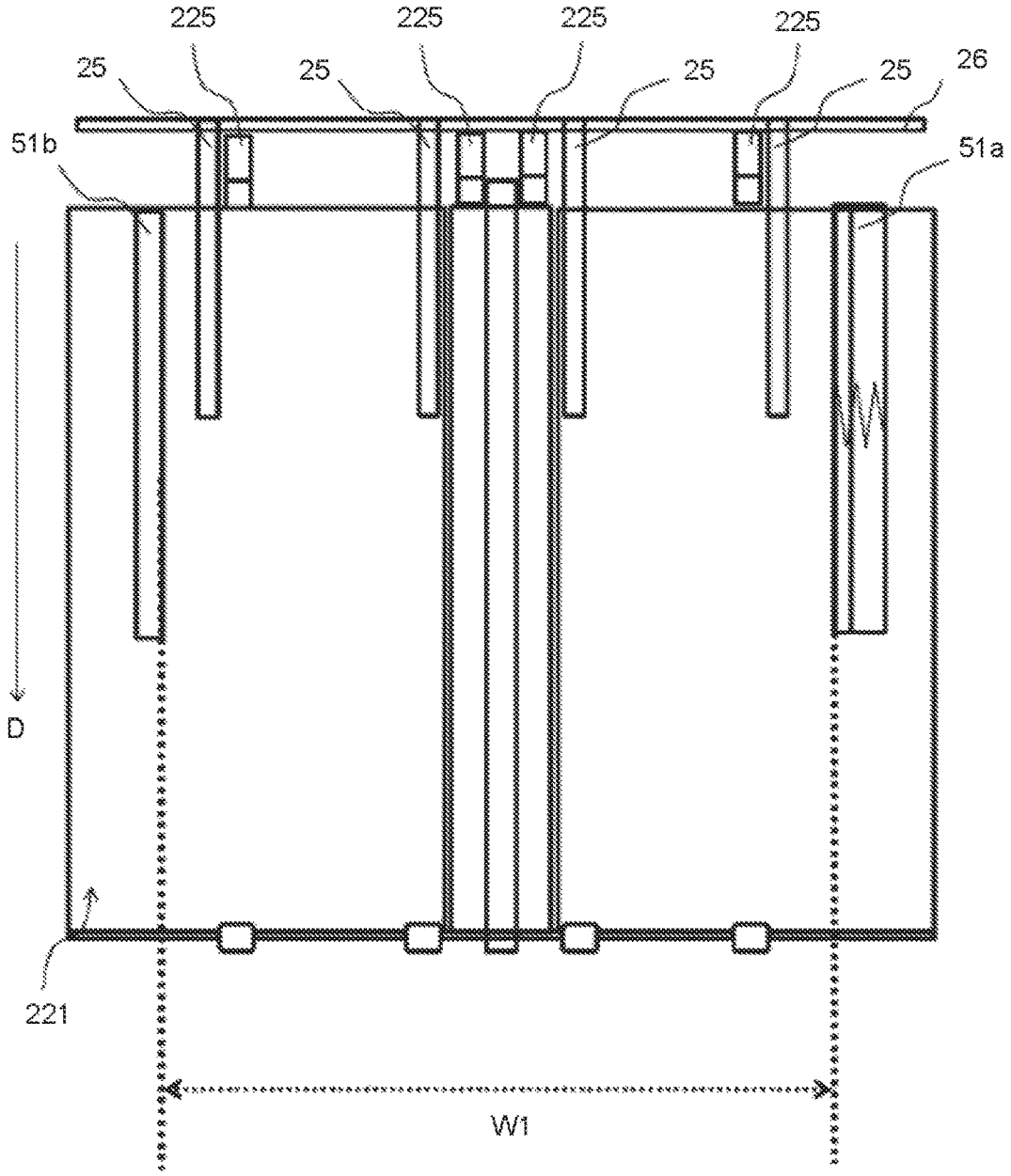
FIG. 6 is a diagram illustrating home positions of a first horizontal alignment plate and a second horizontal alignment plate according to the present embodiment.

FIG. 6 is a diagram illustrating home positions of the horizontal alignment section 51 (the first horizontal alignment plate 51*a* and the second horizontal alignment plate 51*b*). At the home positions, the first horizontal alignment plate 51*a* and the second horizontal alignment plate 51*b* are positioned at positions with an interval of a distance W1 therebetween in the width direction of the sheet S.

Figure 7:
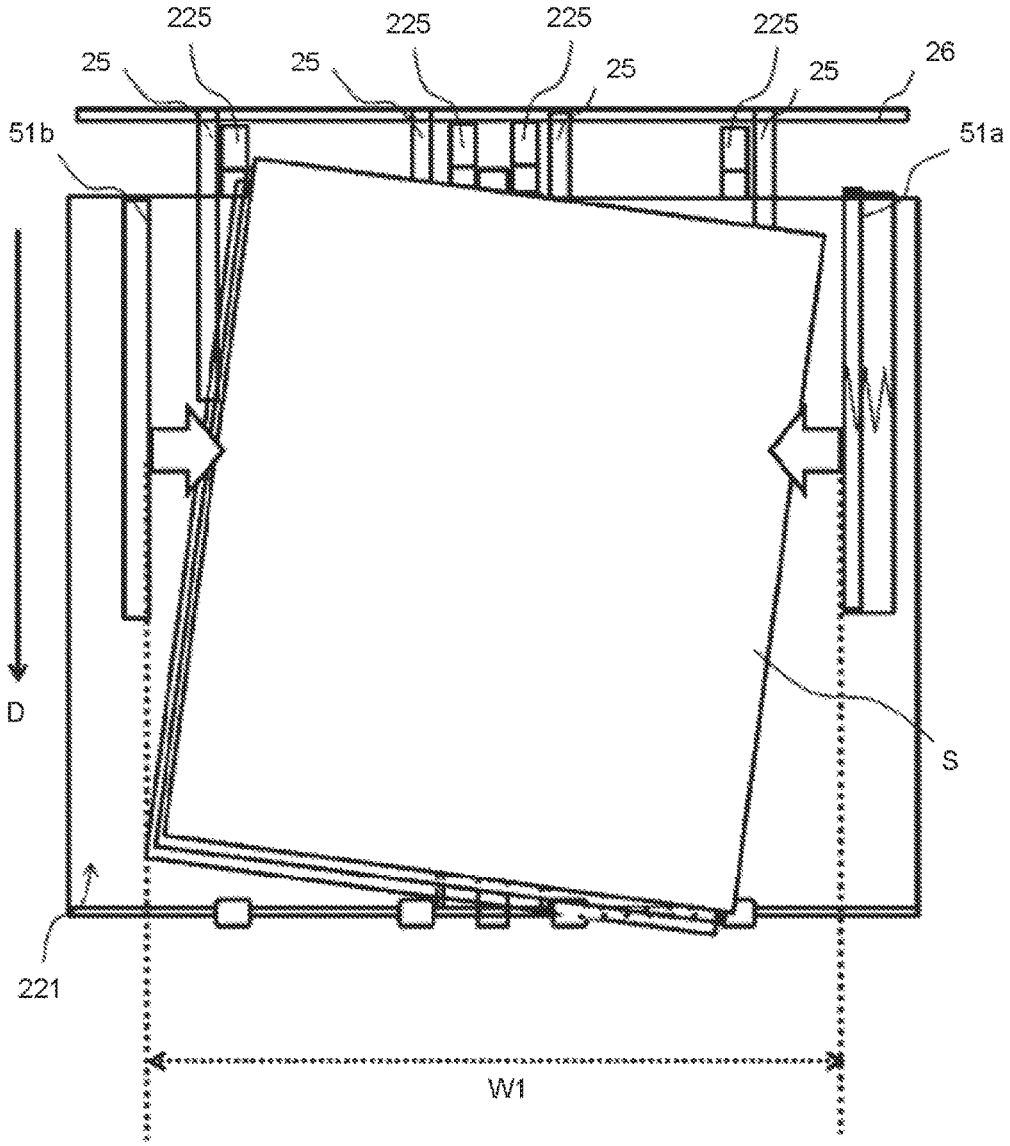
FIG. 7 is a diagram illustrating a state in which a sheet is moved and loaded onto the processing tray.

FIG. 7 is a diagram illustrating a state in which a plurality of sheets S from the standby tray 211 is moved and loaded onto the processing tray 221. The first horizontal alignment plate 51*a* and the second horizontal alignment plate 51*b* move at only a predetermined distance in a direction (direction towards the center part of the processing tray 221) indicated by arrows shown in FIG. 7 from the home positions and sandwich the sheet S. In other words, the first horizontal alignment plate 51*a* and the second horizontal alignment plate 51*b* move towards each other in a direction (in an approaching direction) in which the interval therebetween becomes narrow.

Figure 8:
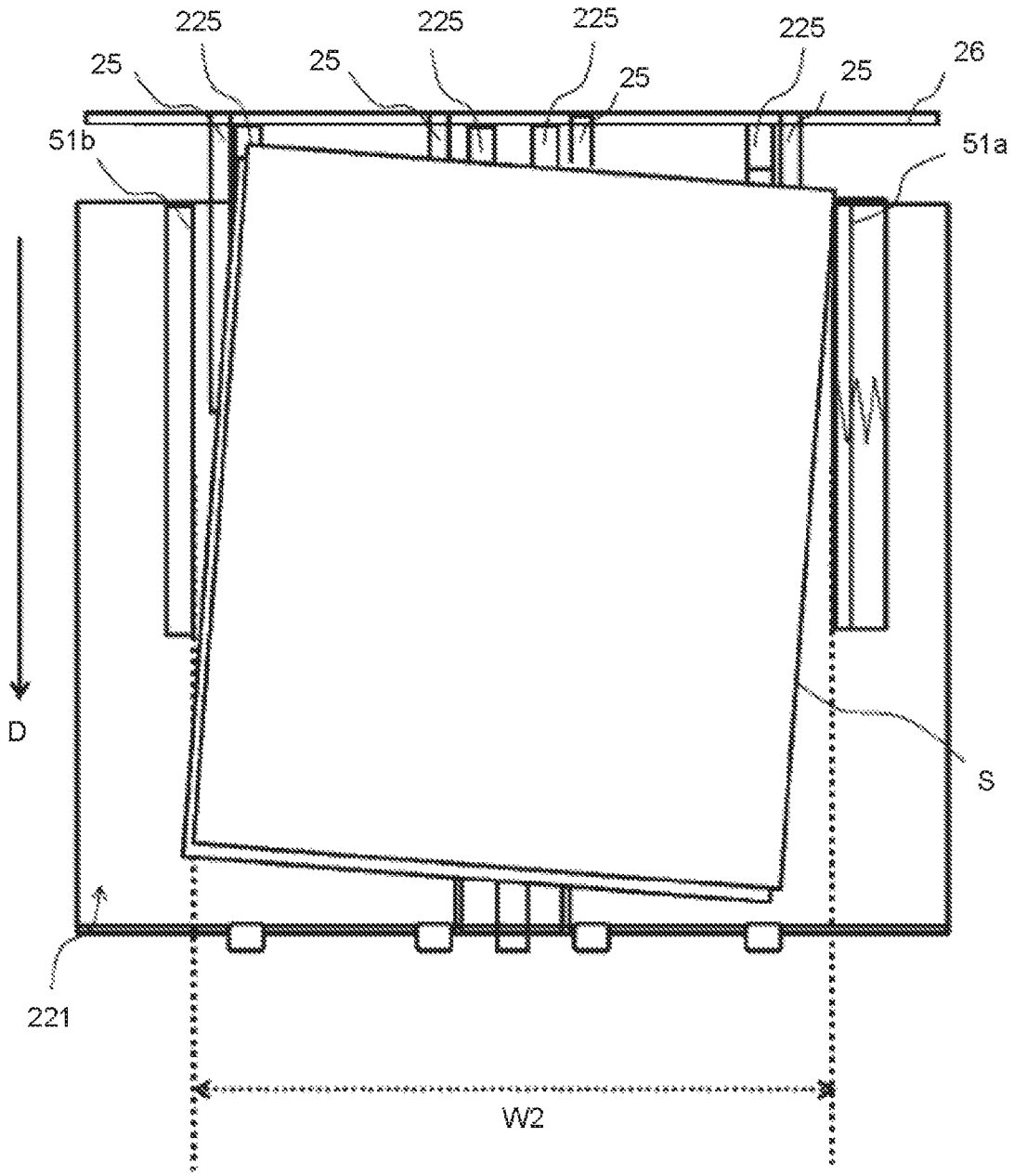
FIG. 8 is a diagram illustrating a state in which the first horizontal alignment plate and the second horizontal alignment plate are positioned at first horizontal alignment positions.

FIG. 8 is a diagram illustrating a state in which the first horizontal alignment plate 51*a* and the second horizontal alignment plate 51*b* are positioned at first horizontal alignment positions. The "first horizontal alignment positions" refer to positions at which an interval of a distance W2 (<W1) exists between the first horizontal alignment plate 51*a* and the second horizontal alignment plate 51*b* in the width direction of the sheet S. The distance W2 is preset to be a distance shorter than the distance W1 at the home positions and longer than the length of the sheet S serving as an aligned object in the width direction of the sheet S.

The first horizontal alignment plate 51*a* and the second horizontal alignment plate 51*b* stop at the first horizontal alignment positions after moving from the home positions (refer to FIG. 6). The first horizontal alignment plate 51*a* and the second horizontal alignment plate 51*b* sandwich a plurality of the sheets S therebetween at the first horizontal alignment positions to adjust deviation in the sheet width direction.

Figure 9:
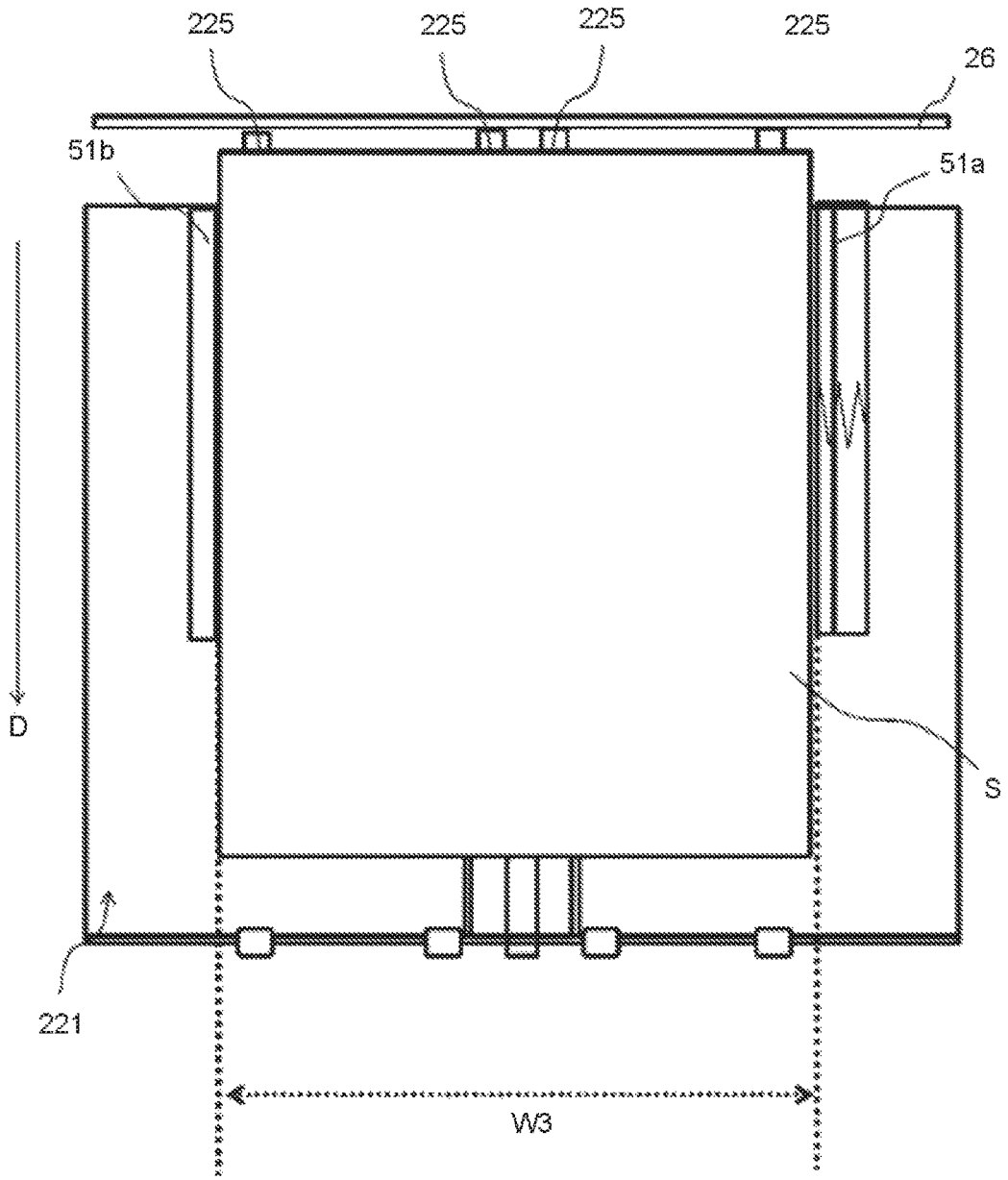
FIG. 9 is a diagram illustrating a state in which the first horizontal alignment plate and the second horizontal alignment plate are positioned at second horizontal alignment positions.

FIG. 9 is a diagram illustrating a state in which the first horizontal alignment plate 51*a* and the second horizontal alignment plate 51*b* are positioned at second horizontal alignment positions. The "second horizontal alignment positions" refer to positions at which an interval of a distance W3(<W2) exists between the first horizontal alignment plate 51*a* and the second horizontal alignment plate 51*b* in the width direction of the sheet S. The distance W3 is preset to be a distance nearly identical to the length of the sheet S serving as the aligned object in the width direction of the sheet S. The distance W3 is shorter than the distance W1 at the home positions and shorter than the distance W2 at the first horizontal alignment positions.

The first horizontal alignment plate 51*a* and the second horizontal alignment plate 51*b* stop at the second horizontal alignment positions after further moving at only a predetermined distance in the direction towards the center part of the processing tray 221 from the first horizontal alignment positions (refer to FIG. 8). The first horizontal alignment plate 51*a* and the second horizontal alignment plate 51*b* move to the second horizontal alignment positions to sandwich a plurality of the sheets S to further adjust the deviation in the sheet width direction. In the present embodiment, in an operation of positioning the first horizontal alignment plate 51*a* and the second horizontal alignment plate 51*b* to the "second horizontal alignment positions", the second horizontal alignment plate 51*b* is firstly driven to be positioned at the position in FIG. 9. After that, the first horizontal alignment plate 51*a* is driven to be positioned at the position in FIG. 9 to execute the horizontal alignment processing.

Figure 10:
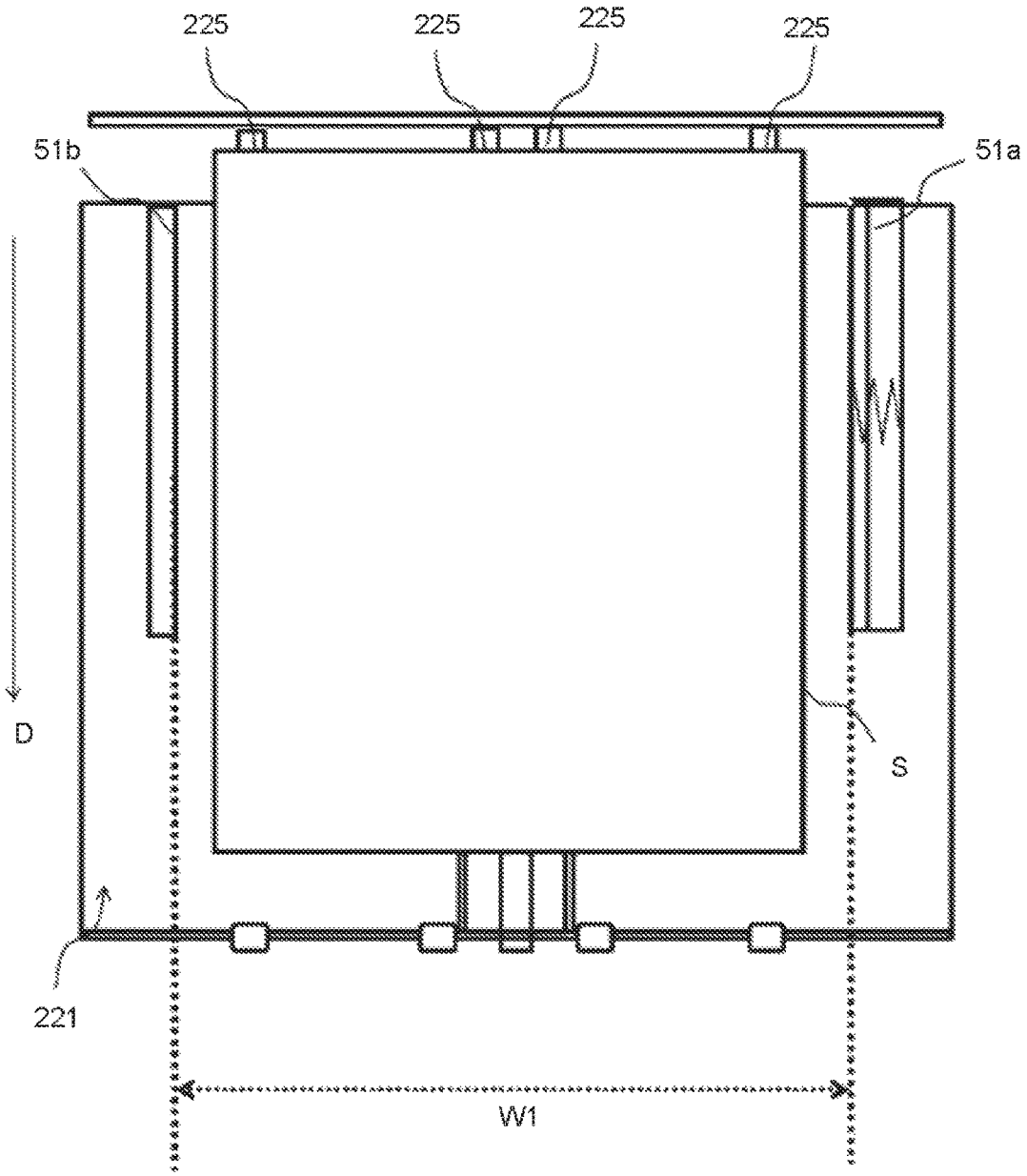
FIG. 10 is a diagram illustrating a state in which the first horizontal alignment plate and the second horizontal alignment plate move to the home positions after they carries out a horizontal alignment processing on a plurality of sheets.

FIG. 10 is a diagram illustrating a state in which the first horizontal alignment plate 51*a* and the second horizontal alignment plate 51*b* move to the home positions after carrying out the horizontal alignment processing on the sheets S at the second horizontal alignment positions.

The above is a series of the horizontal alignment processing executed by the first horizontal alignment plate 51*a* and the second horizontal alignment plate 51*b*.

Figure 11:
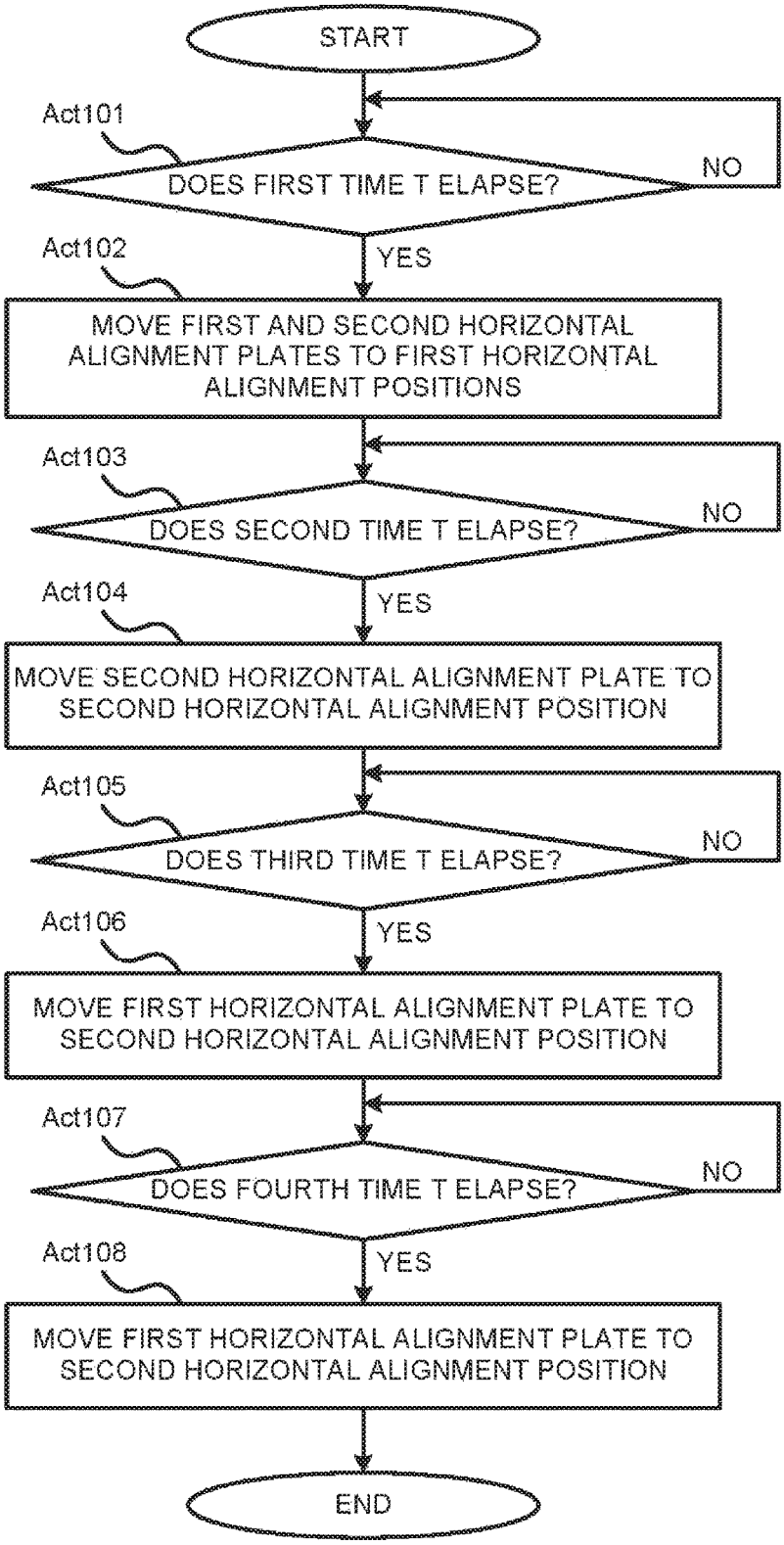
FIG. 11 is a flowchart illustrating the horizontal alignment processing executed by the first horizontal alignment plate and the second horizontal alignment plate under the control of a controller.

FIG. 11 is a flowchart illustrating the horizontal alignment processing executed by the horizontal alignment section 51 under the control of the controller 24.

The controller 24 determines whether or not first time elapses after a rotation operation of the paddle section 25 described later is started (Act 101). If it is determined that the first time elapses (Yes in Act 101), the controller 24 drives the first horizontal alignment motor 29*a* and the second horizontal alignment motor 29*b* at the predetermined number of steps. The first horizontal alignment plate 51*a* and the second horizontal alignment plate 51*b* are located at the first horizontal alignment positions (refer to FIG. 8) after moving at only the predetermined distance in the direction towards the center part of the processing tray 221 from the home positions (refer to FIG. 7) (Act 102). In other words, the first horizontal alignment plate 51*a* and the second horizontal alignment plate 51*b* are located at the first horizontal alignment positions after moving in the direction in which the distance therebetween becomes narrow.

The controller 24 determines whether or not predetermined second time (>the first time) elapses after the rotation operation of the paddle section 25 is started (Act 103). If it is determined that the second time elapses (Yes in Act 103), the processing control section 24 drives the second horizontal alignment motor 29*b* at the predetermined number of steps. The second horizontal alignment plate 51*b* is located at the second horizontal alignment position (refer to FIG. 9) after further moving at only the predetermined distance in the direction towards the center part of the processing tray 221 from the first horizontal alignment position (refer to FIG. 8) (Act 104). If it is determined that the second time does not elapse (No in Act 103), the controller 24 waits for the start of the drive of the second horizontal alignment plate 51*b*.

The controller 24 determines whether or not predetermined third time (>the second time) elapses after the rotation operation of the paddle section 25 is started (Act 105). If it is determined that the third time elapses (Yes in Act 105), the controller 24 drives the first horizontal alignment motor 29*a* at the predetermined number of steps. The first horizontal alignment plate 51*a* is located at the second horizontal alignment position (refer to FIG. 9) after further moving at only the predetermined distance in the direction towards the center part of the processing tray 221 from the first horizontal alignment position (refer to FIG. 8) (Act 106). If it is determined that the third time does not elapse (No in Act 105), the controller 24 waits for the start of the drive of the first horizontal alignment plate 51*a*.

In this way, through shifting the moving timing of the first horizontal alignment plate 51*a* and that of the second horizontal alignment plate 51*b*, after determining the position of the second horizontal alignment plate 51*b* serving as a reference position at the time of executing the horizontal alignment processing in advance, the first horizontal alignment plate 51*a* containing the damper moves at only the predetermined distance in the direction towards the center of the processing tray 221 to execute the horizontal alignment processing to adjust the deviation in the width direction of the sheet at the predetermined position with high accuracy.

Further, both of operations of the first horizontal alignment plate 51*a* and the second horizontal alignment plate 51*b* including "movement from the home positions to the first horizontal alignment positions" and "movement from the first horizontal alignment positions to the second horizontal alignment positions" are the movement to the direction towards the center of the processing tray 221. Thus, after the horizontal alignment plates sandwich the sheets to execute the horizontal alignment processing, as it is not necessary to return the horizontal alignment plates in the direction of the home positions in order to execute the horizontal alignment processing again, the time of the processing needed in the horizontal alignment processing can be shortened.

Next, the controller 24 determines whether or not predetermined fourth time (>the third time) elapses after the rotation operation of the paddle section 25 is started (Act 107). If it is determined that the fourth time elapses (Yes in Act 107), the controller 24 reversely drives the first horizontal alignment motor 29*a* and the second horizontal alignment motor 29*b* at the predetermined number of steps. The first horizontal alignment plate 51*a* and the second horizontal alignment plate 51*b* move at only the predetermined distance in the mutually separating direction from the second horizontal alignment positions (refer to FIG. 9) and are located at the home positions (refer to FIG. 10) (Act 108), and waits for that the sheets to which the horizontal alignment processing is executed are discharged to the movable tray 23*b*. Through the above, a series of the horizontal alignment processing executed by the horizontal alignment section 51 under the control of the controller 24 is terminated.

A series of operations of the vertical alignment processing executed by the first paddle 25*a* and the second paddle 25*b* is described with reference to FIG. 12 to FIG. 18.

Figure 12:
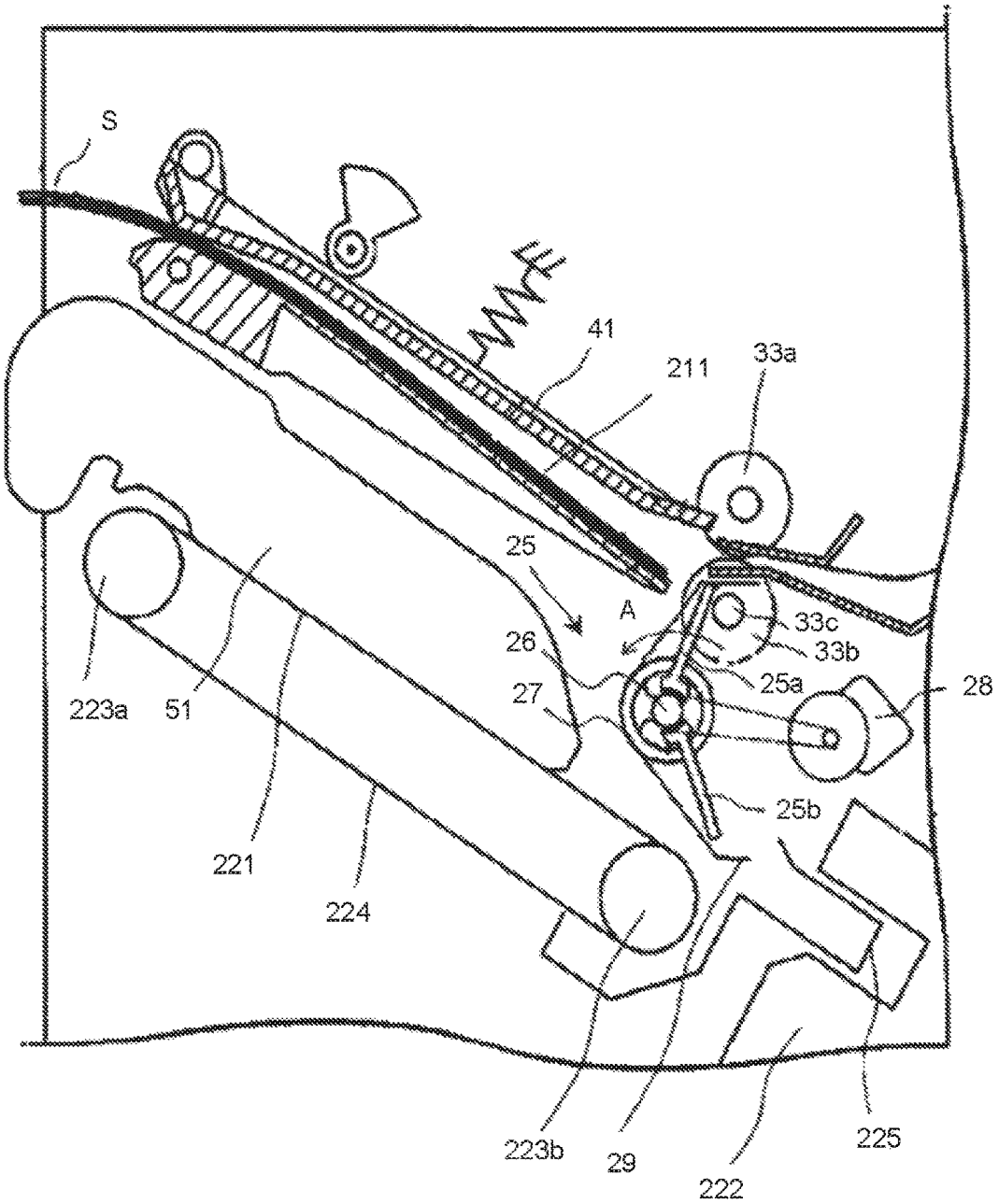
FIG. 12 is a diagram illustrating standby positions of a first paddle and a second paddle according to the present embodiment.

FIG. 12 is a diagram illustrating standby positions before the first paddle 25*a* and the second paddle 25*b* are driven to rotate. The "standby positions" refer to positions at which the first paddle 25*a* and the second paddle 25*b* stand by at the time the sheet S is buffered from the exit rollers 33*a* and 33*b* towards the standby tray 211 or the sheet S is immediately sent from the exit rollers 33*a* and 33*b* to the processing tray 221. In other words, the "standby positions" refer to the positions at which the first paddle 25*a* and the second paddle 25*b* do not carry out the vertical alignment processing on the sheets.

In FIG. 12, the first paddle 25*a* is arranged at a position at which the first paddle 25*a* does not protrude towards the downstream side of the sheet conveyance direction ID with respect to the outer peripheral surface of the exit roller 33*b* when viewed from an axis 33*c* of the exit roller 33*b*. From a different point of view, when viewed from the standby tray 211, the first paddle 25*a* is located at the upstream side of the conveyance direction with respect to the outer peripheral surface of the exit roller 33*b* located in the vicinity of the standby tray 211 and is arranged at a position at which the conveyance of the sheet S conveyed from the exit roller 33*b* to the standby tray 211 is not disturbed. The second paddle 25*b* is arranged at a position at which the front end part thereof is separated from the sheets S on the processing tray 221 at only a predetermined distance.

Figure 13:
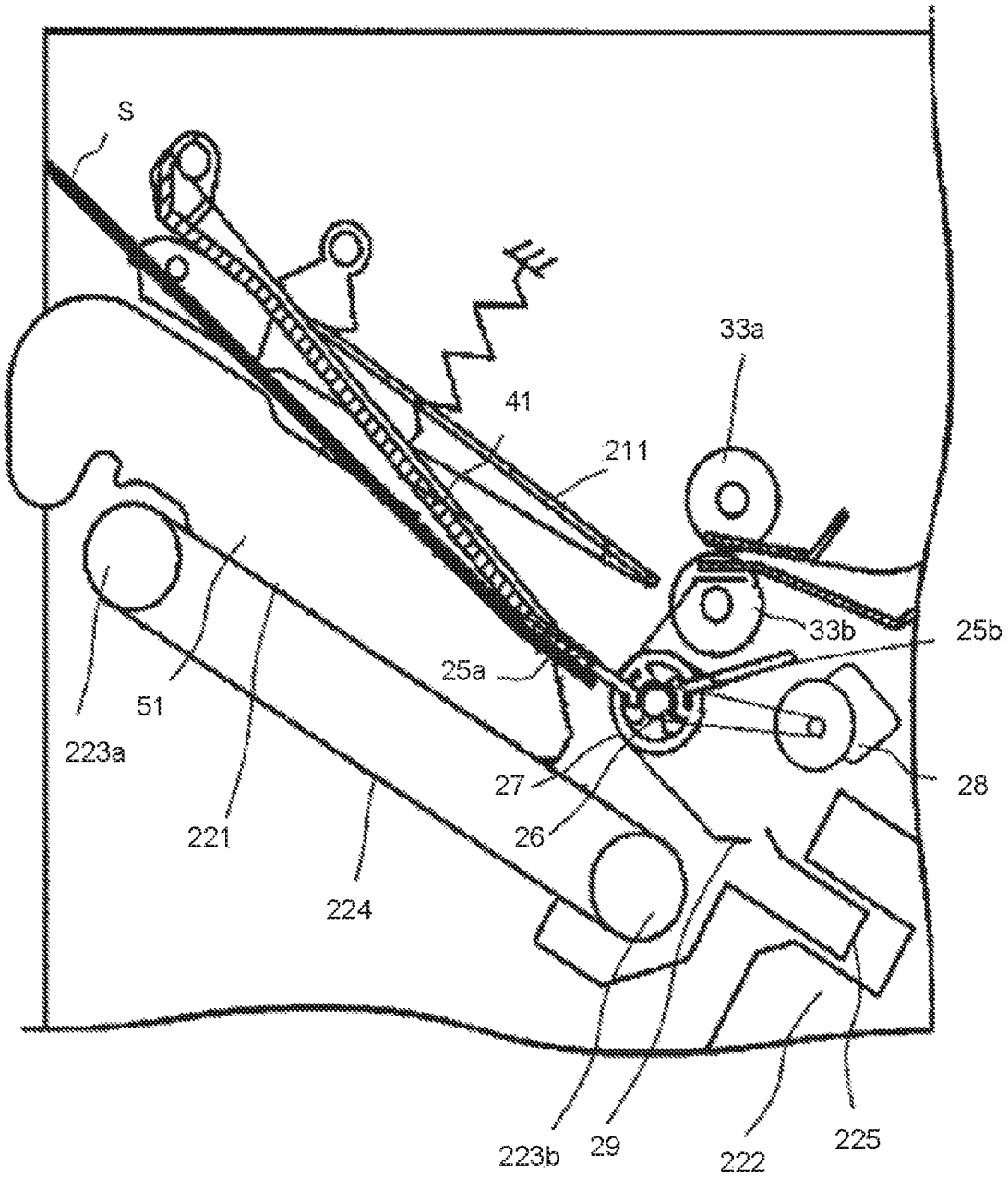
FIG. 13 is a diagram illustrating a sheet moving processing by the first paddle according to the present embodiment.

FIG. 13 is a diagram illustrating a state in which the first paddle 25*a* contacts with the sheet S to be moved from the standby tray 211 to the processing tray 221. If the predetermined number of sheets S is buffered on the standby tray 211, the controller 24 drives a pair of the standby tray members 211*a* and 211*b* in the mutually separating direction in the sheet width direction W to move the buffered sheets S to the processing tray 221.

The controller 24 drives the paddle motor 28 to rotate the rotational axis 26. The first paddle 25*a* is rotated accompanying the rotation of the rotational axis 26 to contact with the sheet S dropped from the standby tray 211 at a speed V1 to apply force for moving the sheet S towards the processing tray 221.

Figure 14:
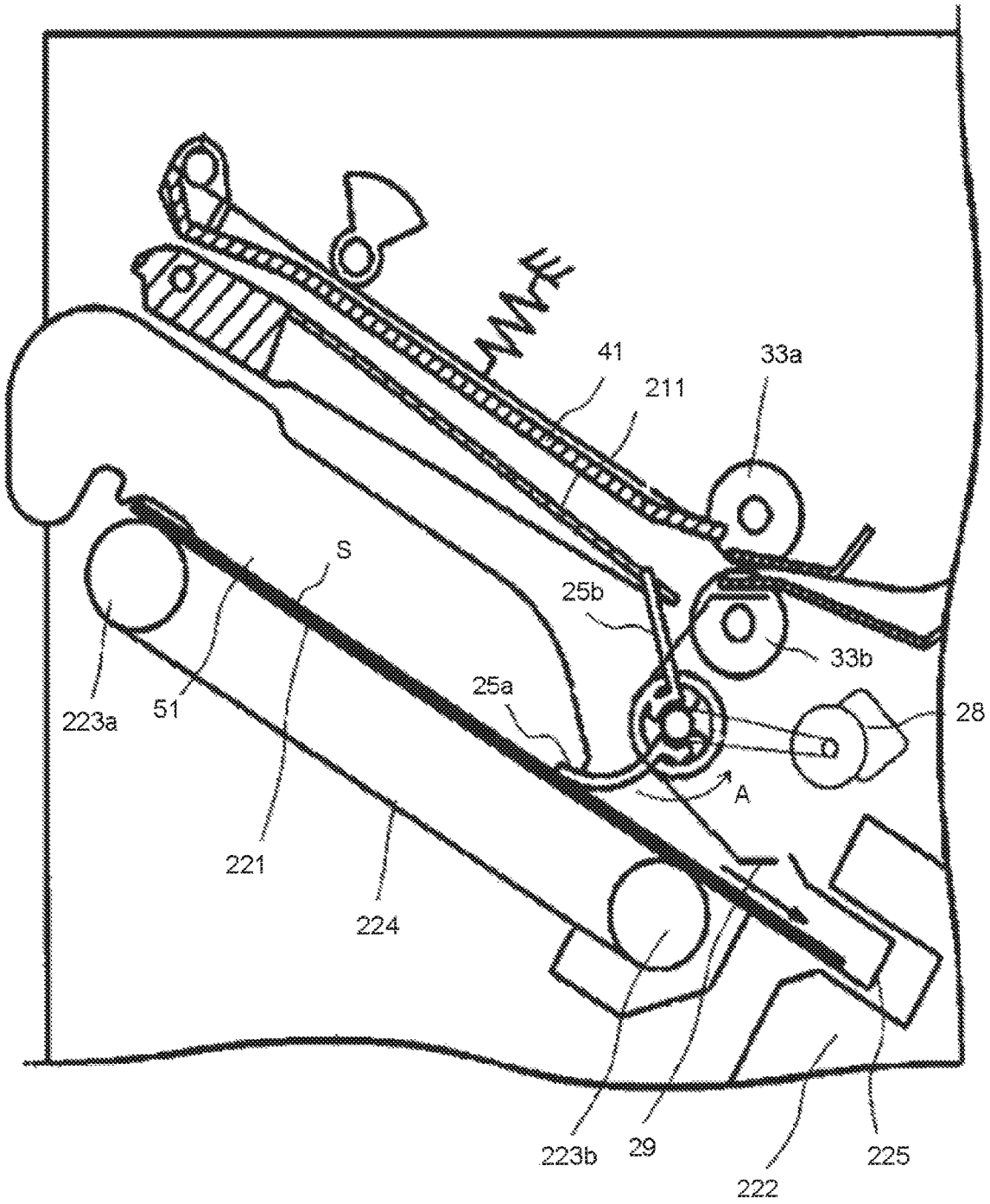
FIG. 14 is a diagram illustrating a vertical alignment processing by the first paddle according to the present embodiment.

FIG. 14 is a diagram illustrating an operation of carrying out the vertical alignment processing on the sheets S moved to the processing tray 221 by the first paddle 25*a* through the further rotation of the first paddle 25*a* in the arrow A direction (in the counter-clockwise direction).

The first paddle 25*a* is further rotated in the arrow A direction from the state shown in FIG. 13 to guide the sheet S onto the processing tray 221 and contacts with the processing tray 221 across the sheet S to become a bent state (refer to FIG. 14). The first paddle 25*a* is rotated in the arrow A direction at a speed V2 to be kept in the bent state and moves the sheet S towards the stopper 225 located at the upstream side of the sheet conveyance direction from the processing tray 221. In other words, the first paddle 25*a* sandwiches a plurality of the sheets S together with the processing tray 221 to draw the sheets S towards the stopper 225 to carry out the vertical alignment processing.

Figure 15:
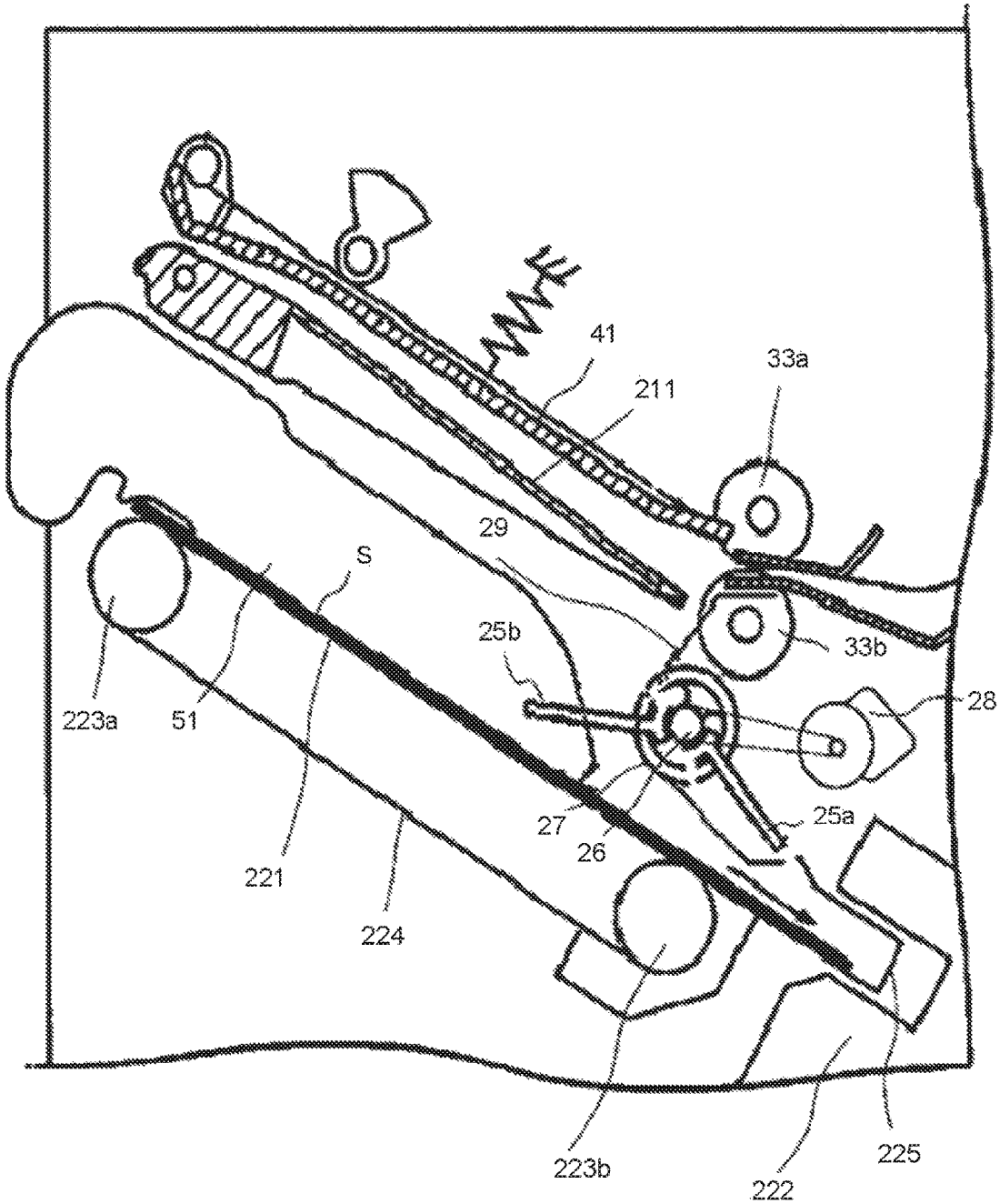
FIG. 15 is a diagram illustrating stop positions of the first paddle and the second paddle according to the present embodiment.

FIG. 15 is a diagram illustrating states of the first paddle 25*a* and the second paddle 25*b* after the vertical alignment processing on the sheets S by the first paddle 25*a* shown in FIG. 14.

The controller 24 controls the paddle motor 28 to stop the rotation of the rotational axis 26 if the first paddle 25*a* arrives at a position away from the sheets S on the processing tray 221 after the vertical alignment processing on the sheets S is carried out by the first paddle 25*a*. In this way, the rotation of the first paddle 25*a* and the second paddle 25*b* is stopped. The second paddle 25*b* is stopped in such a way as to be positioned at the position away from the sheets S on the processing tray 221 at only the predetermined distance. In other words, after the vertical alignment processing on the sheets S is carried out by the first paddle 25*a*, the first paddle 25*a* and the second paddle 25*b* mutually stop at the positions away from the sheets S on the processing tray 221 at only the predetermined distance.

The reason why the first paddle 25*a* and the second paddle 25*b* are stopped at the positions away from the sheets S on the processing tray 221 at only the predetermined distance is described as follows. After the vertical alignment processing is carried out on the sheets S by the first paddle 25*a*, a processing (horizontal alignment processing) of aligning the end parts of the width direction of the sheets in the sheet width direction W is executed by the horizontal alignment plate 51. At the time of the horizontal alignment processing, if the first paddle 25*a* or the second paddle 25*b* contacts with the sheet S, the processing (horizontal alignment processing) of aligning the end parts of the width direction of the sheets is disturbed, and thus the first paddle 25*a* and the second paddle 25*b* are separated from the sheet S.

Figure 16:
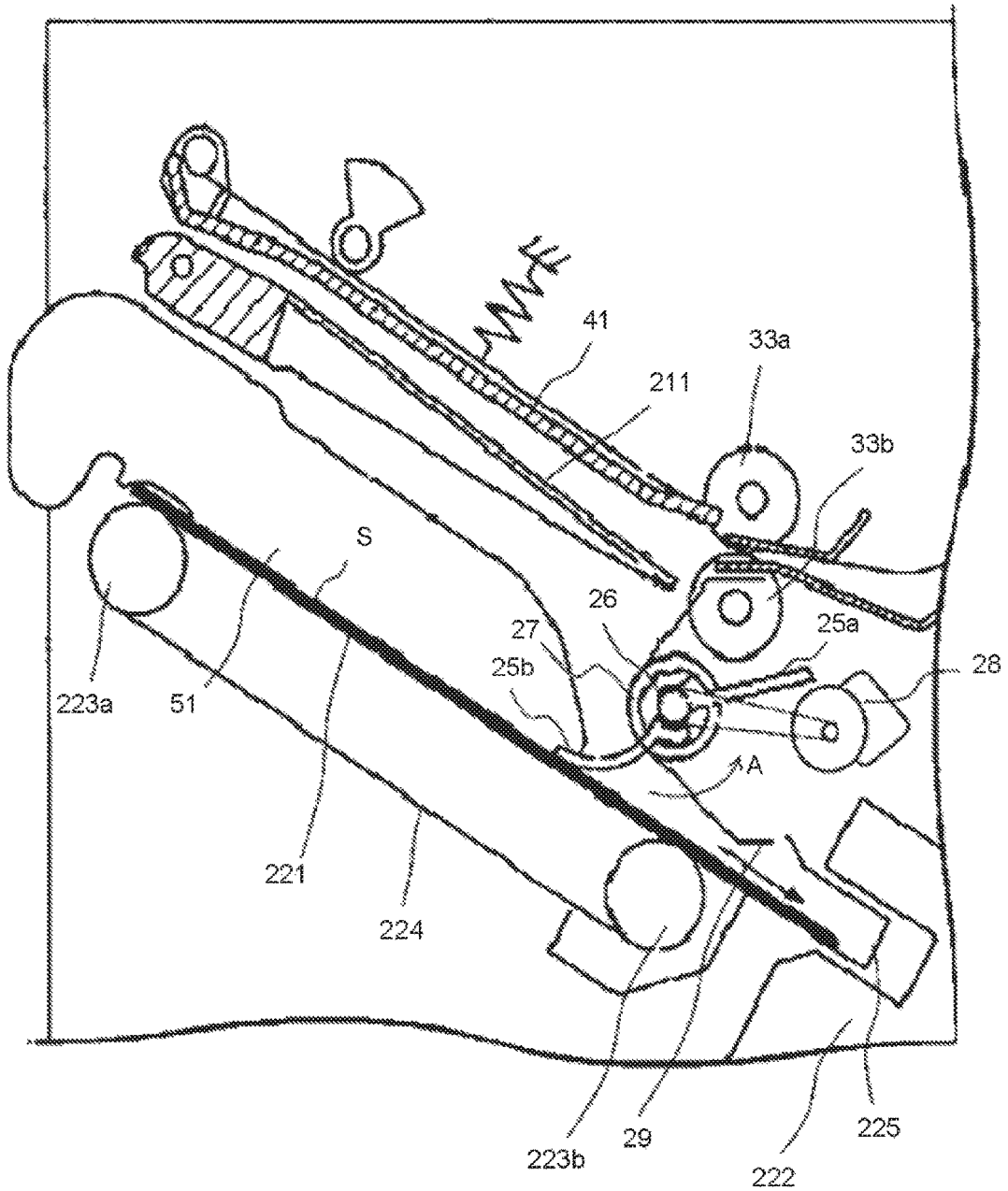
FIG. 16 is a diagram illustrating a vertical alignment processing by the second paddle according to the present embodiment.

FIG. 16 is a diagram illustrating the operation of carrying out the vertical alignment processing on the sheets S on the processing tray 221 by the second paddle 25*b*. The controller 24 controls the drive of the paddle motor 28 to rotate the first paddle 25*a* and the second paddle 25*b* again in the arrow A direction. The first paddle 25*a* and the second paddle 25*b* receive the drive of the paddle motor 28 to rotate in the counter-clockwise direction.

Hereinafter, the second paddle 25*b* is concentratedly described. The second paddle 25*b* contacts with the sheet S in the bent state to carry out a drawing-in operation towards the stopper 225.

The reason why the vertical alignment processing is further carried out through the second paddle 25*b* is described as follows. When the first paddle 25*a* draws the sheet S into the stopper 225, there is a case in which the drawing-in quantity of the sheets S becomes excessive. In this case, the sheets S abut against the stopper 225 and are moved towards the sheet conveyance direction D through repulsive force, and there is a possibility that the alignment of the sheets S in the sheet conveyance direction cannot be executed with high accuracy. Thus, after the first paddle 25*a* carries out the drawing-in operation of the sheet S, the second paddle 25*b* carries out the drawing-in operation again to execute the vertical alignment processing again on the sheets S to which the vertical alignment processing cannot be sufficiently carried out by the first paddle 25*a*, and it is possible to improve aligning properties in the sheet conveyance direction. While the first paddle 25*a* makes one rotation, it is possible to execute the vertical alignment processing twice by the first paddle 25*a* and the second paddle 25*b*, which contributes to the high speed of the sheet processing without the need of rotating the paddle section for many times.

Figure 17:
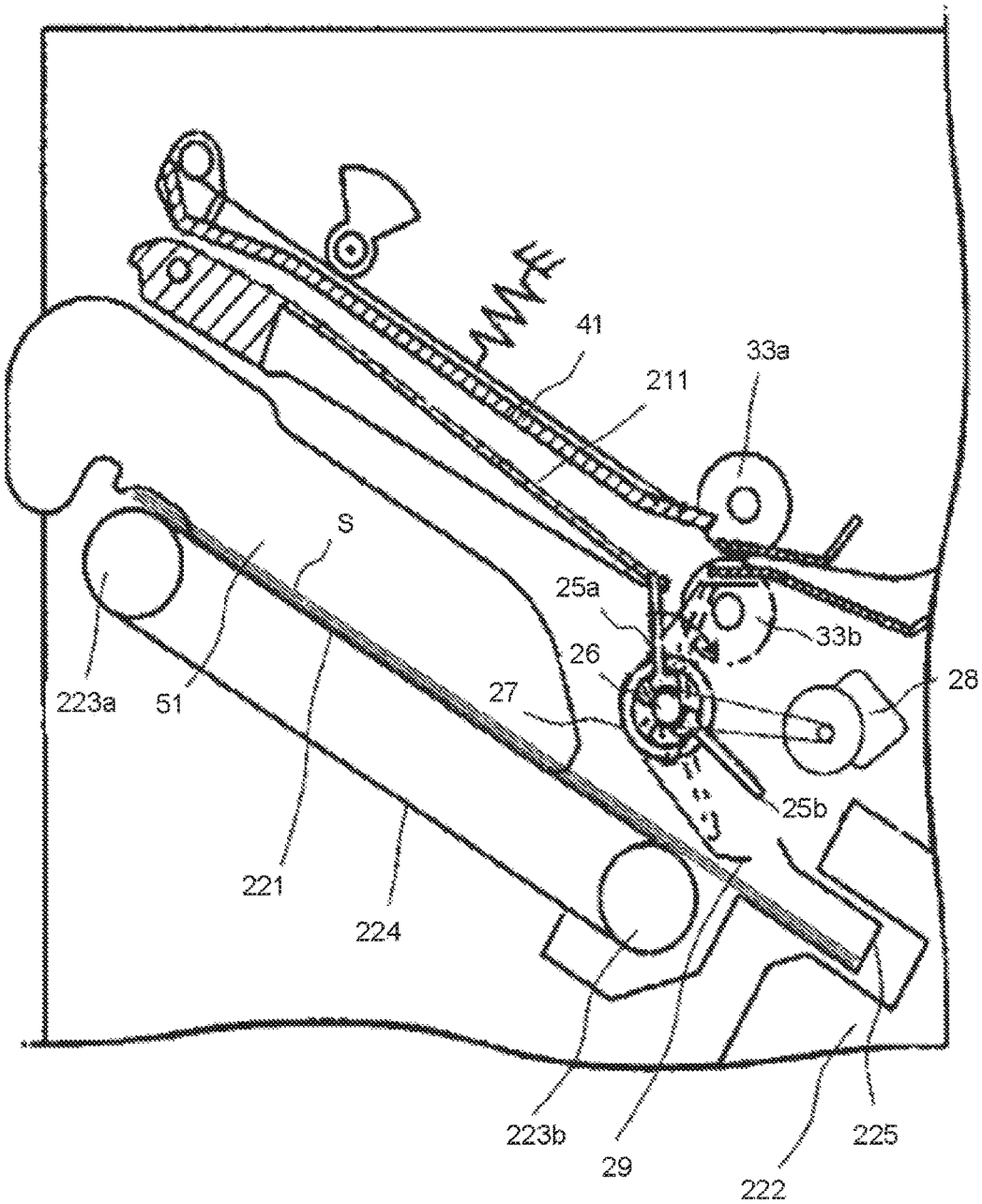
FIG. 17 is a diagram illustrating a state after the vertical alignment processing is completed by the first paddle and the second paddle according to the present embodiment.

FIG. 17 is a diagram illustrating a state after the vertical alignment processing is completed by the first paddle 25*a* and the second paddle 25*b*.

After the vertical alignment processing is executed by the second paddle 25*b*, the first paddle 25*a* and the second paddle 25*b* stop after rotating to the positions indicated by solid lines in FIG. 17. Dotted lines shown in FIG. 17 indicate the standby positions of the first paddle 25*a* and the second paddle 25*b* shown in FIG. 12. The controller 24 rotates the first paddle 25*a* and the second paddle 25*b* to the positions (positions indicated by the solid lines) exceeding the standby positions after the vertical alignment processing by the second paddle 25*b* to certainly separate the second paddle 25*b* after the vertical alignment processing from the sheets S on the processing tray 221. In this way, the second paddle 25*b* stops in a state where it contacts with the sheets S on the processing tray 221, and it is suppressed that a negative influence is applied to the sheet aligning properties at the time succeeding sheets are conveyed to the processing tray.

Then, the controller 24 controls the paddle motor 28 to rotate in a direction (in a clockwise direction) opposite to the arrow A direction and positions the first paddle 25*a* and the second paddle 25*b* at the standby positions.

Figure 18:
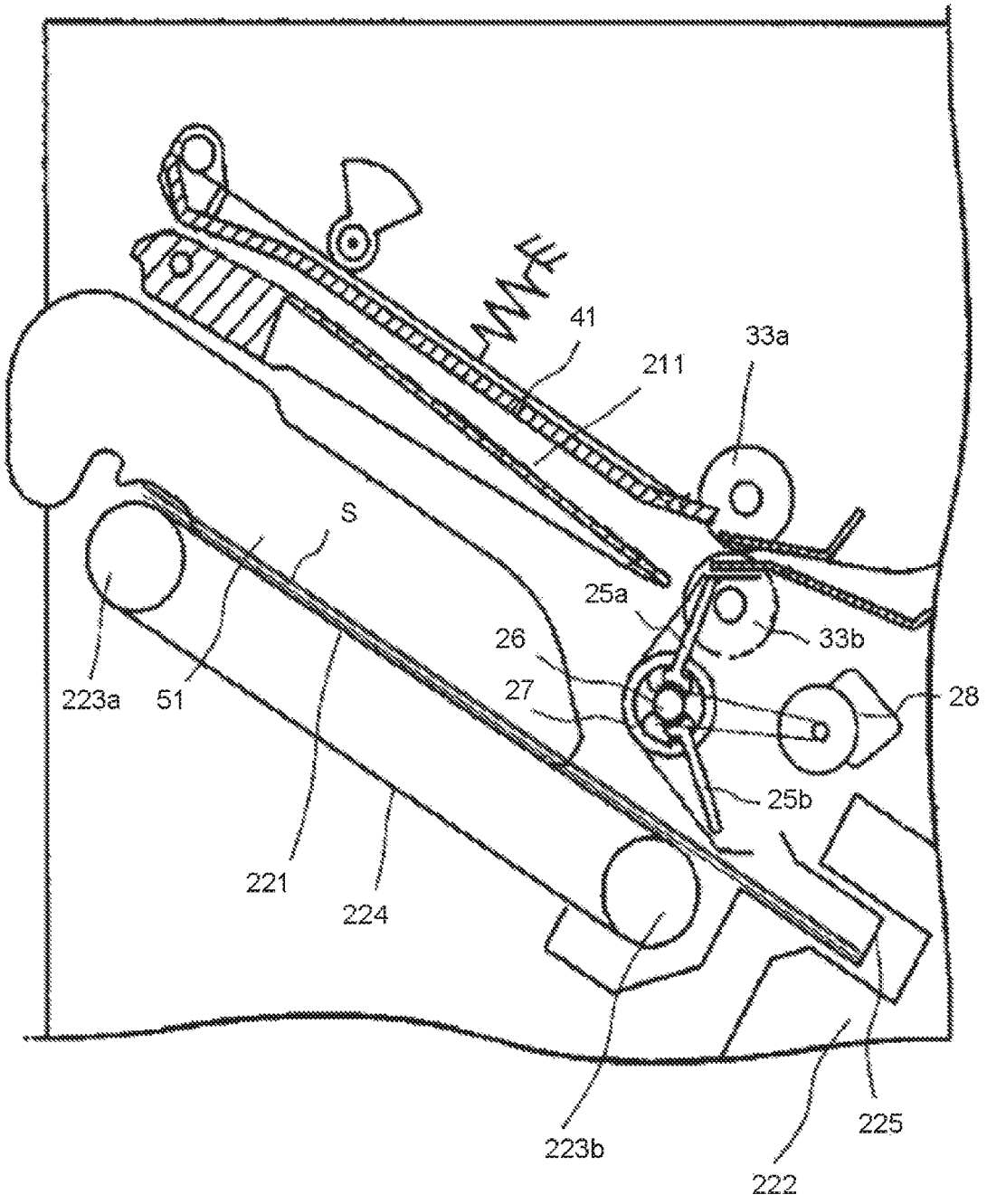
FIG. 18 is a diagram illustrating the standby positions of the first paddle and the second paddle after the vertical alignment processing according to the present embodiment.

FIG. 18 is a diagram illustrating a state where the first paddle 25*a* and the second paddle 25*b* return to the standby positions. The first paddle 25*a* and the second paddle 25*b* wait for that the succeeding sheets are received by the standby tray 211 in a state where they are located at the standby positions.

Next, the flow of the horizontal alignment processing and the vertical alignment processing on the sheets on the processing tray 221 by the horizontal alignment section 51 (the first horizontal alignment plate 51*a* and the second horizontal alignment plate 51*b*) and the paddle section 25 is described.

Figure 19:
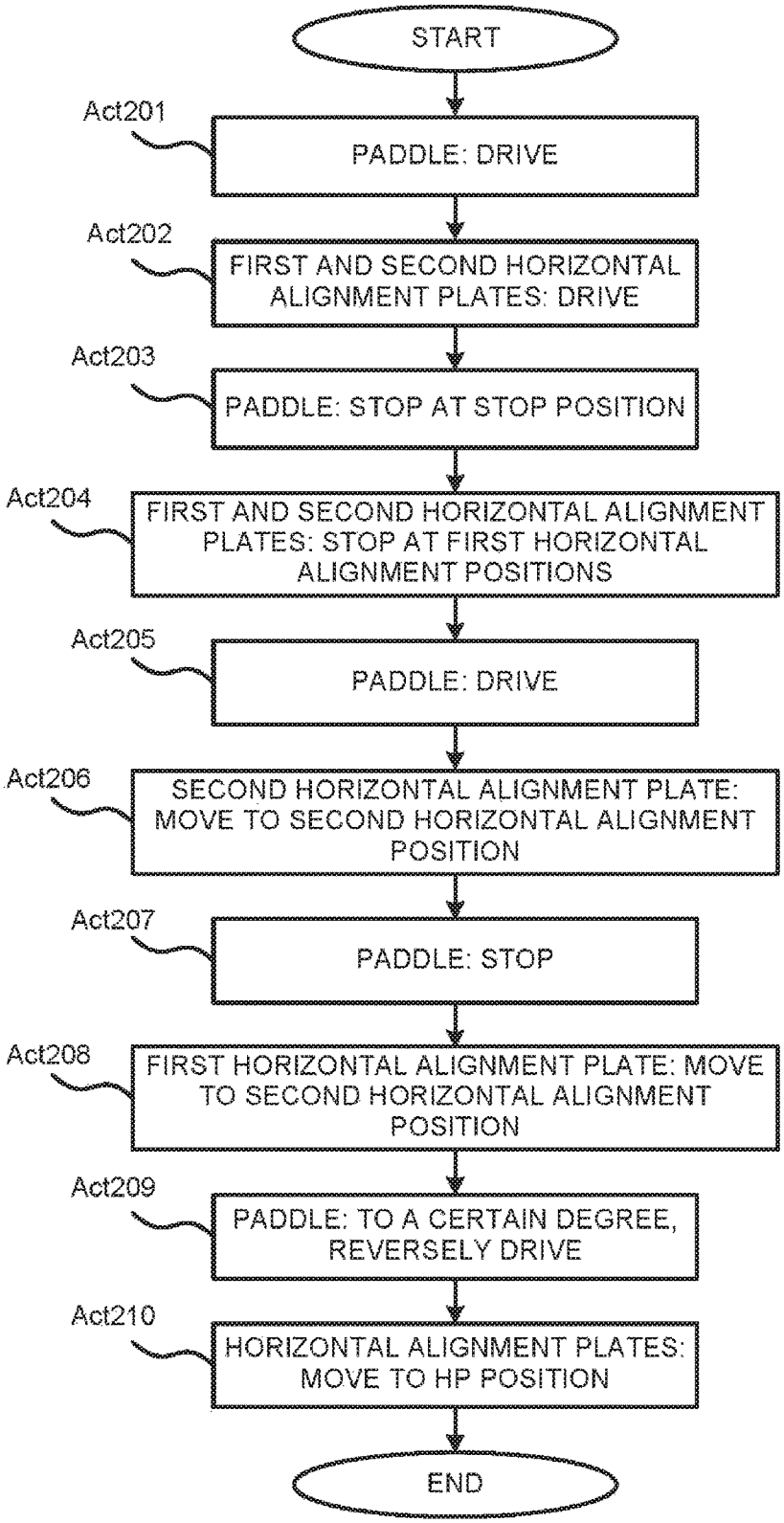
FIG. 19 is a flowchart illustrating the horizontal alignment processing and the vertical alignment processing executed by a horizontal alignment section and a paddle section under the control of the controller.

FIG. 19 is a flowchart illustrating the vertical alignment processing and the horizontal alignment processing executed by the horizontal alignment section 51 and the paddle section 25 under the control of the controller 24.

If the predetermined number of sheets is buffered on the standby tray 211, the controller 24 drives the standby tray 211 to make it separated from the sheets in the width direction of the sheet S. A plurality of the sheets S is moved from the standby tray 211 to the processing tray 221. The controller 24 drives the paddle section 25 to rotate. The paddle section 25 assists the movement of a plurality of the sheets S to be moved from the standby tray 211 to the processing tray 221. The paddle section 25 executes the vertical alignment processing on a plurality of the sheets S moved to the processing tray 221 (Act 201).

Next, the controller 24 drives the first horizontal alignment plate 51*a* and the second horizontal alignment plate 51*b* (Act 202). The first horizontal alignment plate 51*a* and the second horizontal alignment plate 51*b* start to move from the home positions (refer to FIG. 7) towards the first horizontal alignment positions (refer to FIG. 8).

After the paddle section 25 (first paddle 25*a*) executes the vertical alignment processing, the controller 24 stops the rotation of the paddle section 25 (Act 203). The paddle section 25 stops rotating and is positioned at the position shown in FIG. 15.

Next, the controller 24 stops the drive of the first horizontal alignment plate 51*a* and the second horizontal alignment plate 51*b* (Act 204). The first horizontal alignment plate 51*a* and the second horizontal alignment plate 51*b* are positioned at the first horizontal alignment positions (refer to FIG. 8) to be stopped. As the paddle section 25 is separated from a plurality of the sheets S on the processing tray 221, the first horizontal alignment plate 51*a* and the second horizontal alignment plate 51*b* can execute the horizontal alignment processing without being influenced by the paddle section 25.

Then, the controller 24 drives the paddle section 25 to rotate again (Act 205). The paddle section 25 is rotated again in the counter-clockwise direction from the position in FIG. 15 to further execute the vertical alignment processing on a plurality of the sheets S to which the horizontal alignment processing is executed by the second paddle 25*b* in Act 204.

As the first horizontal alignment plate 51*a* and the second horizontal alignment plate 51*b* are positioned at the first horizontal alignment positions (refer to FIG. 8) having the distance W2 (distance slightly wider than the width of the sheet) therebetween in the direction orthogonal to the conveyance direction of the sheet, the deviation between the sheets can be suppressed at the time of the vertical alignment processing.

Next, the controller 24 starts the drive of the second horizontal alignment plate 51*b* and then stops the drive thereof after the second horizontal alignment plate 51*b* is driven to a certain degree (Act 206). The second horizontal alignment plate 51*b* starts to move from the first horizontal alignment position towards the second horizontal alignment position and stops moving if it arrives at the second horizontal alignment position.

The controller 24 stops the rotation of the paddle section 25 (Act 207). The paddle section 25 is positioned at the position indicated by the solid lines shown in FIG. 17 to be stopped.

The controller 24 starts the drive of the first horizontal alignment plate 51*a* and then stops the drive of thereof after the first horizontal alignment plate 51*a* is driven to a certain degree (Act 208). The first horizontal alignment plate 51*a* starts to move from the first horizontal alignment position towards the second horizontal alignment position and stops moving if it arrives at the second horizontal alignment position. Herein, the first horizontal alignment plate 51*a* further executes the horizontal alignment processing on a plurality of the sheets S to which the horizontal alignment processing is executed once in Act 204 and a plurality of the sheets S to which the vertical alignment processing is executed by the paddle section 25 for many times.

The controller 24 reversely rotates the paddle section 25 (Act 209). The paddle section 25 is reversely rotated to stop at the standby position shown in FIG. 18.

The controller 24 moves the first horizontal alignment plate 51*a* and the second horizontal alignment plate 51*b* to the home positions (refer to FIG. 10) (Act 210). The first horizontal alignment plate 51*a* and the second horizontal alignment plate 51*b* are moved from the second horizontal alignment positions (refer to FIG. 9) to the home positions (refer to FIG. 10). Through the above, a series of processing is completed.

Through the above, the following effects are realized according to the present embodiment.

As the first horizontal alignment plate and the second horizontal alignment plate are positioned the second horizontal alignment positions the distance between which is narrower than that between the first horizontal alignment positions in the direction orthogonal to the conveyance direction of the sheet after positioned at the first horizontal alignment positions by the controller, it is possible to shorten the time spent in aligning a plurality of the sheets. Further, the movement of the first horizontal alignment plate and the second horizontal alignment plate from the home positions to the first horizontal alignment positions and the movement thereof from the first horizontal alignment positions to the second horizontal alignment positions are the movement towards the mutually approaching direction. Thus, after the first horizontal alignment plate and the second horizontal alignment plate sandwich the sheets to execute the horizontal alignment processing, as it is unnecessary to return each horizontal alignment plate in the direction of the home position again, the time of the processing needed in the horizontal alignment processing can be shortened.

Further, through shifting the moving timing of the first horizontal alignment plate and that of the second horizontal alignment plate, after determining the position of the second horizontal alignment plate serving as the reference position at the time of executing the horizontal alignment processing previously, the first horizontal alignment plate containing the damper moves at only the predetermined distance to execute the horizontal alignment processing, and thus, the deviation of the sheets in the width direction of the sheet at the predetermined position can be adjusted with high accuracy.

After the paddle section executes the vertical alignment processing, as the first horizontal alignment plate and the second horizontal alignment plate are positioned at the first horizontal alignment positions and the second horizontal alignment positions in sequence to execute the horizontal alignment processing, the deviation of the sheets in the width direction of the sheet can be adjusted with high accuracy.

After the first horizontal alignment plate and the second horizontal alignment plate are positioned at the first horizontal alignment positions to execute the horizontal alignment processing, as the paddle section executes the vertical alignment processing, the deviation of the sheets in the width direction of the sheet can be suppressed compared with a case in which the first horizontal alignment plate and the second horizontal alignment plate executes the horizontal alignment processing in a state where the first horizontal alignment plate and the second horizontal alignment plate are positioned at the home positions.

Further, after the first horizontal alignment plate and the second horizontal alignment plate are positioned at the first horizontal alignment positions to execute the horizontal alignment processing, the paddle section executes the vertical alignment processing, after that, as the first horizontal alignment plate and the second horizontal alignment plate are positioned at the second horizontal alignment positions to execute the horizontal alignment processing, the deviation of the sheets in the width direction of the sheet can be suppressed.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A sheet processing apparatus, comprising:

a processing tray configured to load sheets to which a post processing is executed;

a pair of alignment plates arranged on the processing tray at a predetermined interval and configured to move in a direction orthogonal to a sheet conveyance direction and align the sheets on the processing tray in the sheet width direction, the pair of the alignment plates has a first alignment plate and a second alignment plate; and a controller configured to control the pair of the alignment plates to move towards each other to first alignment positions at which the sheets are aligned in the direction and stop, control the pair of the alignment plates to move towards each other to second alignment positions without moving the pair of the alignment plates in a reverse direction to align the sheets, control the pair of the alignment plates to move from a home positions to the first alignment positions, an interval between the pair of the alignment plates at the home positions is wider than that at the first alignment positions, control the pair of the alignment plates to move to the second alignment positions in sequence, control the first aliment plate and the second alignment plate to move towards each other at the same time from the home position to the first position, control the second alignment plate to move from the first position to the second position, and control the first alignment plate to move from the first position to the second position after the second alignment plate moves to the second position.

2. The sheet processing apparatus according to claim 1, further comprising:

a vertical alignment member configured to align the sheets on the processing tray in the conveyance direction of the sheet, wherein after the vertical alignment member aligns the sheets on the processing tray, the controller positions the pair of the alignment plates at the first alignment positions to align the sheets.

3. The sheet processing apparatus according to claim 2, wherein the controller is configured to control the vertical alignment member to align the sheets on the processing tray again in the conveyance direction of the sheet after the pair of the alignment plates reaches at the first alignment positions, and control the first alignment plate and the second alignment plate to move to the second alignment positions to align the sheets again in the direction orthogonal to the conveyance direction of the sheet.

4. The sheet processing apparatus according to claim 1, wherein the first alignment plate comprising a damper.

5. A sheet processing method, comprising:

loading sheets on a processing tray;

aligning the sheets in a sheet width direction orthogonal to a sheet conveyance direction using a pair of alignment plates arranged on the processing tray at a predetermined interval;

moving the pair of the alignment plates towards each other, positioning the pair of the alignment plates at first alignment positions at which the sheets are aligned in the sheet width direction;

moving the pair of the alignment plates towards each other from the first positions;

positioning the pair of the alignment plates at second alignment positions to align the sheets, an interval between the pair of the alignment plates at the second alignment positions being narrower than that at the first alignment positions;

positioning the pair of the alignment plates from a home positions to the first alignment positions and then the second alignment positions in sequence, an interval between the pair of the alignment plates at the home positions being wider than that at the first alignment positions;

the pair of the alignment plates has a first alignment plate and a second alignment plate; and moving the first aliment plate and the second alignment plate towards each other at the same time from the home position to the first position, moving the second alignment plate from the first position to the second position, and moving the first alignment plate from the first position to the second position after the second alignment plate moves to the second position.

6. The sheet processing method according to claim 5, further comprising:

vertically aligning the sheets on the processing tray in the sheet conveyance direction by using a vertical alignment member, wherein after vertical alignment, positioning the pair of the alignment plates at the first alignment positions to align the sheets.

7. The sheet processing method according to claim 6, further comprising:

controlling the vertical alignment member to align the sheets on the processing tray again in the sheet conveyance direction after the pair of the alignment plates reaches at the first alignment positions; and moving the first alignment plate and the second alignment plate to the second alignment positions to align the sheets again in the sheet width direction.

8. The sheet processing method according to claim 5, wherein the pair of the alignment plates adjusts deviation of sheets in a plurality of sheets on the processing tray in the sheet width direction.

* * * * *